US011495120B2

(12) United States Patent
Pop

(10) Patent No.: US 11,495,120 B2
(45) Date of Patent: Nov. 8, 2022

(54) UNIVERSAL PROGRAMMABLE OPTIC/ACOUSTIC SIGNALING DEVICE WITH SELF-DIAGNOSIS

(71) Applicant: ADVANCETREX SENSOR TECHNOLOGIES CORP., Walnut, CA (US)

(72) Inventor: Florin Emilian Pop, Morton Grove, IL (US)

(73) Assignee: ADVANCETREX SENSOR TECHNOLOGIES CORP., Walnut, CA (US)

( * ) Notice: Subject to any disclaimer, the term of this patent is extended or adjusted under 35 U.S.C. 154(b) by 0 days.

(21) Appl. No.: 16/380,542

(22) Filed: Apr. 10, 2019

(65) Prior Publication Data

US 2019/0311607 A1 Oct. 10, 2019

Related U.S. Application Data

(60) Provisional application No. 62/655,791, filed on Apr. 10, 2018.

(51) Int. Cl.
*G08B 7/06* (2006.01)
*G08B 29/02* (2006.01)

(52) U.S. Cl.
CPC ..... *G08B 29/02* (2013.01); *G08B 7/06* (2013.01)

(58) Field of Classification Search
CPC ..... G08B 29/02; G08B 7/06
See application file for complete search history.

(56) References Cited

U.S. PATENT DOCUMENTS 1,740,845 A * 12/1929 Tilbe ..... G09F 15/0081 40/473
2,625,762 A * 1/1953 Mccoll ..... G09F 23/00 40/607.03

(Continued)

OTHER PUBLICATIONS

"SK9822 Specificaiton Integrated Light Source Intelligent Control (Double Line Transmission) of Chip-on-Top SMD Type LED," Shenzhen Normand Electronic Co., Ltd., Jan. 12, 2016.

(Continued)

*Primary Examiner* — Nay Tun
(74) *Attorney, Agent, or Firm* — HoustonHogle LLP

(57) ABSTRACT

A signaling system includes a universal, programmable, and customizable signaling device. The signaling device includes light indicators, such as a colored light-emitting diode (LED) screen with pixels distributed on an indicating surface of the device facing all directions. A segmented assembly with driver, light, sound, and diagnostic sections allows customization of the device to accommodate different size requirements in different contexts. The signaling device includes both analog and digital inputs for receiving control signals from a monitored system, as well as additional inputs for receiving signaling instructions from a configuration device. Based on the signaling instructions and the control signals, the signaling device presents status information for the monitored system via programmed audible and visual alarms and signaling patterns, including animations. Diagnostic monitors of the signaling device determine a diagnostic status for the device, and a diagnostic indicator presents diagnostic information to ensure that the signaling device is operating normally.

25 Claims, 23 Drawing Sheets

(56) References Cited

U.S. PATENT DOCUMENTS 3,105,315 A * 10/1963 Snethen ..... G09F 13/04 40/502
3,135,063 A * 6/1964 Ricks ..... G09F 19/14 40/473
3,399,400 A * 8/1968 Lucka ..... G08B 5/36 340/323 R
3,868,671 A * 2/1975 Maguire ..... A63B 71/06 340/323 R
3,962,806 A * 6/1976 Eby ..... G09F 11/02 40/473
4,404,543 A * 9/1983 Kracl ..... G09F 11/02 116/222
5,054,219 A * 10/1991 Hoyt ..... G09F 7/22 40/473
5,416,997 A * 5/1995 Dyment ..... G09F 15/0062 40/473
5,432,473 A * 7/1995 Mattila ..... H03F 1/302 330/133
5,450,094 A * 9/1995 Li ..... G09F 15/0087 345/31
D380,011 S * 6/1997 Pettus ..... D20/10
5,745,101 A * 4/1998 Yamamoto ..... G09G 5/36 345/536
5,860,237 A * 1/1999 Johnson ..... G09F 15/00 40/603
5,870,683 A * 2/1999 Wells ..... H04M 1/72544 455/566
5,894,261 A * 4/1999 Green ..... A63B 71/06 273/371
5,926,122 A * 7/1999 Dalton ..... H03M 1/001 341/110
6,012,243 A * 1/2000 Ledford ..... G09F 7/08 40/406
6,050,012 A * 4/2000 Greenfield ..... G09F 13/04 40/564
6,147,617 A * 11/2000 Kim ..... G09G 3/006 340/664
6,269,570 B1 * 8/2001 Miles ..... G09F 15/00 40/607.03
6,345,458 B1 * 2/2002 Garibian ..... G09F 15/0037 40/506
6,490,512 B1 * 12/2002 Niggemann ..... H05B 47/185 701/29.1
6,571,495 B1 * 6/2003 Margaronis ..... G09F 15/00 40/473
7,504,816 B2 * 3/2009 Laur ..... H02M 1/08 307/2
7,827,714 B2 * 11/2010 Howard ..... F21V 21/116 40/572
7,913,436 B2 * 3/2011 Li ..... G09F 19/02 40/429
8,044,667 B2 * 10/2011 Cortigiani ..... H05B 45/54 324/522
8,362,639 B2 * 1/2013 Nagase ..... H05B 45/385 307/10.8
8,558,463 B2 * 10/2013 Sato ..... H05B 45/58 315/130
8,607,488 B2 * 12/2013 Johnston ..... G09F 15/0075 256/1
8,766,546 B2 * 7/2014 Oshima ..... H05B 45/54 315/185 R
8,896,319 B2 * 11/2014 Liao ..... H05B 45/46 324/537
8,947,284 B2 * 2/2015 Ishii ..... H03M 1/1023 341/155
9,329,243 B2 * 5/2016 Lin ..... G09G 3/006
9,689,930 B2 * 6/2017 Hopfgartner ..... H05B 45/54
9,805,629 B2 * 10/2017 Lee ..... G09F 13/22
11,039,518 B2 * 6/2021 Blanchard ..... G01R 31/2635
2002/0140380 A1 * 10/2002 Biebl ..... H05B 45/46 315/291
2003/0006979 A1 * 1/2003 Tsuchi ..... G09G 3/3688 345/204
2003/0160703 A1 * 8/2003 Kurose ..... G09G 3/006 340/815.45
2003/0192219 A1 * 10/2003 Vincent ..... A47G 1/14 40/720
2004/0075811 A1 * 4/2004 Liberman ..... A61H 5/00 351/203
2007/0188368 A1 * 8/2007 Kobayashi ..... H03M 1/005 341/155
2008/0110067 A1 * 5/2008 Smith ..... G09F 13/00 40/541
2009/0021496 A1 * 1/2009 Silzars ..... G09F 13/22 345/204
2009/0260266 A1 * 10/2009 Li ..... G09F 11/02 40/473
2009/0300955 A1 * 12/2009 Puglisi ..... G09F 23/00 40/334
2010/0182218 A1 * 7/2010 Daniel ..... G09F 9/33 345/1.3
2011/0107635 A1 * 5/2011 Walters ..... G09F 15/0075 40/612
2011/0148479 A1 * 6/2011 Aoki ..... H04L 27/22 327/113
2012/0062988 A1 * 3/2012 Watanabe ..... G02B 30/26 359/462
2012/0166947 A1 * 6/2012 Miwa ..... G10H 1/0066 715/716
2012/0286683 A1 * 11/2012 Radermacher ..... H05B 45/37 315/201
2012/0306386 A1 * 12/2012 Oshima ..... H05B 45/54 315/185 R
2013/0074386 A1 * 3/2013 Santarelli ..... G09F 23/06 40/606.01
2015/0268852 A1 * 9/2015 Otsuka ..... G06F 1/163 345/173
2015/0310812 A1 * 10/2015 Chen ..... G09G 3/3696 345/691
2016/0030829 A1 * 2/2016 Rowsey ..... A63B 71/0669 340/323 R
2016/0121195 A1 * 5/2016 Brown ..... A63B 71/0619 40/544
2018/0182329 A1 * 6/2018 Yu ..... G09G 3/3685

OTHER PUBLICATIONS

"WS2812 Intelligent Control LED Integrated Light Source," Worldsemi, Jan. 5, 2012.

* cited by examiner

UNIVERSAL PROGRAMMABLE OPTIC/ACOUSTIC SIGNALING DEVICE WITH SELF-DIAGNOSIS

RELATED APPLICATIONS

This application claims the benefit under 35 USC 119(e) of U.S. Provisional Application No. 62/655,791, filed on Apr. 10, 2018, which is incorporated herein by reference in its entirety.

BACKGROUND OF THE INVENTION

Signaling systems are used to monitor systems such as industrial production lines, utility vehicles and other machines, construction sites, highway systems, hospitals, chemical plants, and electrical distribution systems, to list a few examples. In general, these signaling systems present status information for the monitored system via light and/or sound indicators, which emit light and/or sound indicative of a status of the monitored system.

SUMMARY OF THE INVENTION

Signaling systems often use dedicated signaling devices designed to handle specific situations or industrial applications. These devices are not universal; in order to alter the functionality of the signaling devices, it is often necessary to replace them entirely.

The presently disclosed signaling system includes a universal, programmable, and customizable signaling device that can be applied to wide variety of contexts and whose functionality can be updated or modified as required.

The signaling device includes light indicators, such as a colored light-emitting diode (LED) screen (e.g. in shape of a prism, a cylinder, a sphere or a semi-sphere) with pixels distributed on the external surface facing different directions, and thus capable of signaling visually in different or all directions, offering possibly a 360° range of viewing angles. This device can be produced using prebuilt flexible and/or rigid signaling light columns of light emitting diode (LED) pixels using a variety of different sizes and LED densities, allowing customization of the signaling devices to accommodate different size requirements in different signaling contexts.

Input modules of the signaling device allow further customization. For example, the signaling device can include both analog and digital inputs for receiving control signals from a monitored system, as well as additional inputs for receiving signaling instructions, for example, from a configuration device. Based on the signaling instructions and the control signals, the signaling device presents status information for the monitored system via programmed audible and visual alarms and signaling patterns, including animations.

The status information is information pertaining to the safety and/or functionality of the monitored system and includes or is based upon possibly a wide range of factors within the monitored system such as detected conditions (e.g. measurements or sensor data indicating physical capacity, pressure, temperature, fluid volume), machine or system status (e.g. state information indicating fault conditions), operational status (e.g. whether the monitored system is in an emergency state), security and/or safety procedures (e.g. restricted areas, behaviors or actions), and generally information about any urgent or potentially dangerous situations within or affecting the monitored system.

The signaling device further includes self-diagnosing capability. Diagnostic monitors determine a diagnostic status for the device and a diagnostic indicator to present diagnostic information to individuals pertinent to the monitored system, ensuring that the signaling device is operating normally.

In general, according to one aspect, the invention features a signaling device for presenting status information for a monitored system. The signaling device comprises an assembly, which includes a plurality of indicating surfaces arranged at different viewing directions around the assembly. Light indicators of the signaling device are arranged across the indicating surfaces and present the status information (e.g. by emitting light visible to observers in any of the viewing directions with respect to the signaling device). Input modules of the signaling device receive control signals from the monitored system as well as signaling instructions from a configuration device, and a controller of the signaling device drives the light indicators based on the control signals and the signaling instructions.

In embodiments, the assembly has specifically a cylindrical or prism shape and is divided into functional segments along an axis of the assembly. These functional segments include a light segment comprising the indicating surfaces and the light indicators. An axial length of the light segment can be customized.

The arrangement of indicating surfaces and light indicators preferably provide a range of potential viewing directions of 360 degrees.

The light indicators include addressable pixels. The signaling instructions might include maps representing these addressable pixels with pixel data for each of the addressable pixels indicating illumination and/or color status for the pixels as well as animation scripts indicating different sequences of maps (which represent animations to be presented via the light indicators, for example).

The signaling device might include a solar power generation module for powering the signaling device. This solar power generation module includes a backup battery for providing backup power.

Similarly, the signaling device might include a wireless transceiver module for wirelessly receiving the control signals from the monitored system and relaying the control signals to the controller of the signaling device via one of the input modules.

The input modules receive digital and/or analog control signals from the monitored system, which, in examples, can be an industrial production line, a utility vehicle, a construction site, a highway monitoring system, a hospital, or a chemical plant.

In general, according to another aspect, the invention features a method for presenting status information for a monitored system. Control signals are received from the monitored system, and signaling instructions are received from a configuration device. Light indicators of a signaling device present status information for the monitored system based on the control signals and the signaling instructions. The light indicators are arranged across a plurality of indicating surfaces of the signaling device, the indicating surfaces being arranged at different viewing directions around an assembly of the signaling device.

In general, according to another aspect, the invention features a signaling device/method for presenting status information for a monitored system. The signaling device includes diagnostic monitors for determining a diagnostic status of the signaling device and a diagnostic indicator for presenting diagnostic information for the signaling device based on the diagnostic status of the device.

In general, according to another aspect, the invention features a signaling device/method for presenting status information for a monitored system. The signaling device includes a sound indicator for emitting sound at different frequencies. The sound indicator presents the status information by emitting sound at audible frequencies and also has a diagnostic monitor for detecting the emitted sound and generating diagnostic signals for the detected sound. A controller tests the sound indicator by driving the sound indicator to emit sound at non-audible frequencies and determining a diagnostic status of the sound indicator based on the diagnostic signals.

In general, according to another aspect, the invention features a signaling device/method for presenting status information for a monitored system. The signaling device includes indicators for presenting the status information based on control signals and input modules for receiving the control signals from the monitored system. The input modules automatically process the control signals as analog or digital control signals based on polarities of the received control signals.

In general, according to another aspect, the invention features a signaling device/method for presenting status information for a monitored system. The signaling device includes light indicators for presenting the status information by emitting light, a current monitor for evaluating an electrical load for a circuit providing power to the light indicators, and a controller for determining a diagnostic status of the light indicators based on the evaluated electrical load.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1A:
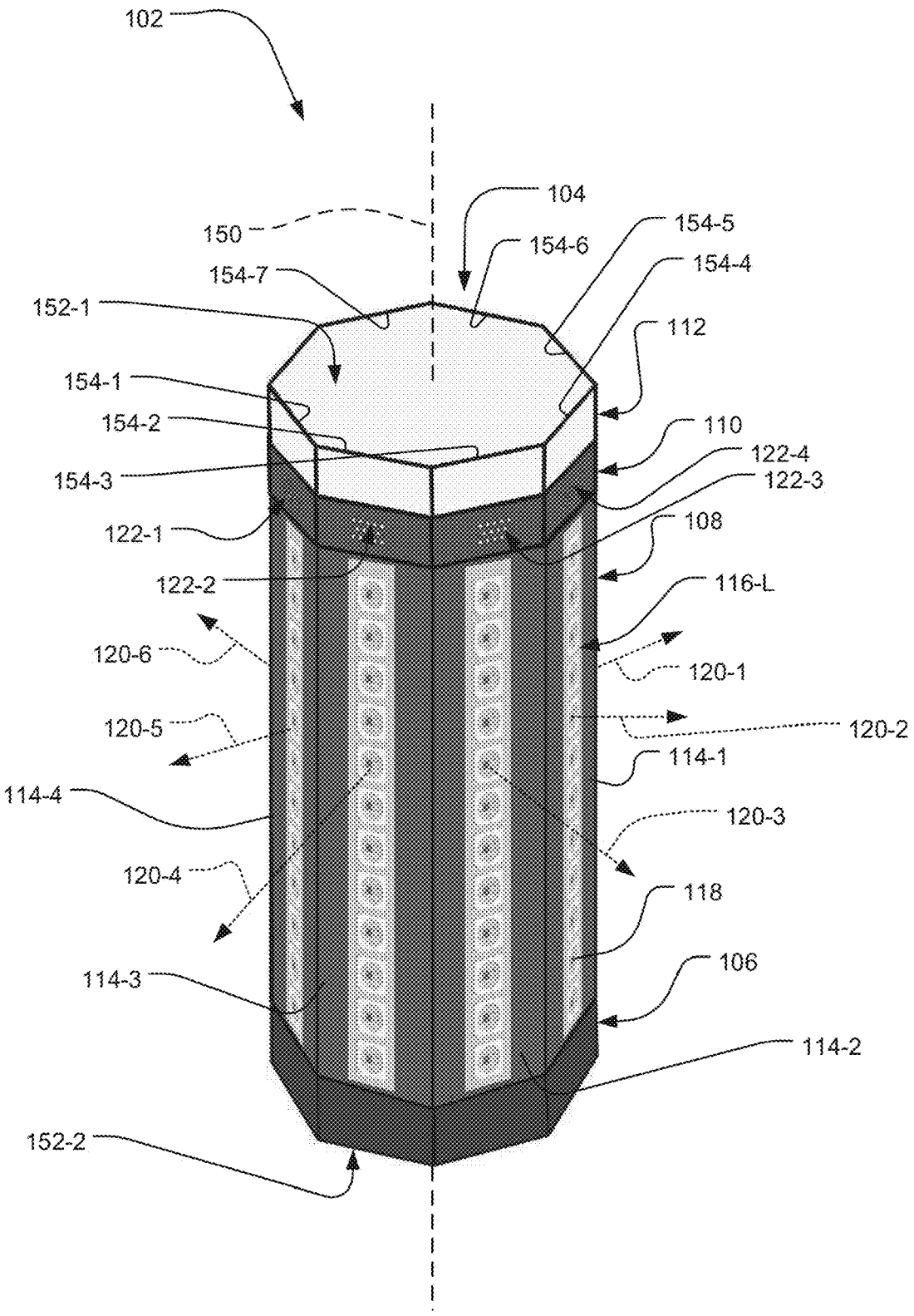
FIG. 1A is a perspective view of an exemplary signaling device for presenting status information for a monitored system, showing an assembly of the signaling device according to one configuration.

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The presently disclosed invention concerns a signaling system 100 for monitoring a monitored system 208 and presenting status information 246 for the monitored system 208 to observers within or associated with the monitored system 208. In general, the signaling system 100 presents the status information 246 via light and/or sound indicators 116, which emit light and/or sound indicative of a status of the monitored system 208.

In examples, the monitored system 208 includes industrial production lines, utility vehicles and other machines, construction sites, highway systems, hospitals, chemical plants, various types of robots, and electrical distribution systems, to list a few examples.

The status information 246 is information pertaining to the safety and/or functionality of the monitored system and includes or is based upon a wide range of factors within the monitored system 208 such as detected conditions (e.g. measurements or sensor data indicating physical capacity, pressure, temperature, fluid volume), machine or system status (e.g. state information indicating fault conditions), operational status (e.g. whether the monitored system is in an emergency state), security and/or safety procedures (e.g. restricted areas, behaviors or actions), and generally information about any urgent or potentially dangerous situations within or affecting the monitored system 208.

FIG. 1A is a perspective view of an exemplary signaling device 102 for presenting the status information 246 according to one configuration.

The signaling device 102 includes a segmented assembly 104 or housing in which the components of the signaling device 102 are enclosed or affixed. In general, the assembly includes a plurality of indicating surfaces 114 arranged at different viewing directions 120 around the assembly 104, with light indicators 116-L arranged across the indicating surfaces 114. The light indicators 116-L present the status information, for example, by emitting light.

The assembly 104 often has a cylindrical or prism shape, wherein a base shape is extruded along an axis 150 perpendicular to a point at the center of the base shape, resulting in parallel top and bottom surfaces 152 having the base shape. Each of the indicating surfaces 114 project radially from the axis 150 along the entire length of the axis from the top surface 152-1 to the bottom surface 152-2 such that the indicating surfaces 114 are bounded at the top and bottom by corresponding edges of the top and bottom surfaces 152 along perimeters of the top and bottom surfaces 152. The indicating surfaces 114 are bounded on each side by common edges between each adjacent pair of indicating surfaces 114, these edges terminating at corresponding vertices along the perimeter of the top and bottom surfaces 152 perpendicular to the top and bottom surfaces 152. In one embodiment, the assembly 104 also includes a transparent or translucent tube or enclosure in which components of the assembly 104 are secured to ensure sealing against water or other liquid intrusion.

The assembly 104 is divided into functional segments 106, 108, 110, 112 along the axis 150, with each of the segments housing or including different components of the signaling device 102 roughly based on the type of functions performed by the components. For example, the assembly 104 includes a driver segment 106, one or more light segments 108, a sound segment 110, and a diagnostic segment 112. In general, electrical components housed within or affixed to each of the segments have electrical connections to those of one or more of the other segments.

In general, the driver segment 106 includes components for powering and directing the functionality of the device. In one embodiment, the driver segment 106 houses a controller 226, non-volatile memory 228, power supply 230, one or more diagnostic monitors 232 (e.g. a current monitor 232-2), input modules 222, a data interface 224, and a sound indicator 116-S (e.g. siren, buzzer, annunciator, speaker/amplifier), which presents the status information 246-S by emitting sound.

The light segment 108 includes components for presenting the status information 246-L by emitting light. Affixed to or mounted at each indicating surface 114 of the light segment 108 are light indicators such as strings of LEDs 116-L, which are strings of addressable, colored LED pixels 118, which present the status information 246-L by emitting light outward from the indicating surface 114 with potential angles between a trajectory of the emitted light and the indicating surface 114 ranging from 0 to 180 degrees, for example. This arrangement of indicating surfaces 114 surrounding the central axis 150 of the assembly 104 with light indicators 116-L affixed to each of the indicating surfaces 114 emitting the light outwards provides a wide range of potential viewing directions 120 (e.g. preferably extending 360 degrees around the axis 150 of the assembly 102). Each of the light indicators 116-L on each indicating surface 114 is electrically connected sequentially to the light indicators 116-L on the two adjacent indicating surfaces 114, for example, forming a single chain spanning all of the light indicators 116-L on all of the indicating surfaces 114.

The sound segment 110 is a waterproof enclosure for outputting the sound emitted by the sound indicator 116-S in all directions. Each indicating surface 114 of the sound segment 110 includes a grill 122, comprising circular holes or openings in the indicating surface 114 extending all the way through the radial thickness of the sound segment 110 into a hollow center in which the sound emitting components are housed. The grills 122 protect the sound indicator 116-S from foreign objects and/or moisture while still allowing the sound to clearly pass. The arrangement of the indicating surfaces 114 surrounding the central axis 150 of the assembly 104 with grills 122 on each of the indicating surfaces 114 allowing the sound to pass outwards provides a wide range of hearing directions for the emitted sound (e.g. extending 360 degrees around the axis 150 of the assembly 102).

In one embodiment, the light segment 108 is a hollow shell, allowing better airflow cooling of the light indicators 116-S and other electrical components of the signaling device 102. This hollow light segment 108 also encloses a waterproof siren piezo element of the sound indicator 116-S, with the hollow cavity providing a resonant cavity for the sound indicator 116-S to emit the sound, which then passes through the grills 122 of the sound segment 110.

The diagnostic segment 112 houses components of the signaling device 102 for presenting diagnostic information 248 indicating a diagnostic status for the signaling device 102, including one or more diagnostic monitors 232 (e.g. a lamp string monitor 232-1) and diagnostic indicators 234, which present the diagnostic information 248, for example, by emitting light based on results of a variety of diagnostic self-tests performed by the device. In one example, if one of these self-tests fails, the diagnostic indicator 234 will turn off (e.g. stop emitting light) to indicate a light string fault or flash with a programmed cadence to indicate that one of the pixels 118 and/or the siren 116-S is malfunctioning. In one embodiment, the diagnostic segment 112 is translucent, allowing light emitted by the diagnostic indicator 234 to pass through each of the indicating surfaces 114 of the diagnostic segment 112 as well as the through the top surface 152-1 of the assembly 104.

In the illustrated example, the assembly 104 is shaped as an octagonal prism, with parallel top and bottom surfaces 152 that are shaped as octagons and eight rectangular indicating surfaces 114. Each of the top and bottom surfaces 152 have eight edges and eight vertices along the perimeter of the surface 152. Each of the eight corresponding pairs of edges along the perimeters of the top and bottom surfaces 152 form the top and bottom boundaries of a corresponding indicating surface 114. Similarly, each of the eight corresponding pairs of top and bottom vertices form termination points of a common linear edge between each adjacent pair of indicating surfaces 114.

In other embodiments, the assembly 104 is a prism having base surfaces that have any number of edges and indicating surfaces 114, such as a triangular prism with three indicating surfaces 114, a rectangular prism or cuboid with four indicating surfaces 114, a pentagonal prism with five indicating surfaces 114, a hexagonal prism with six indicating surfaces 114, or a heptagonal prism with seven indicating surfaces 114, among other examples. Similarly, in one embodiment, the assembly 104 has a cylindrical shape, with a single continuous indicating surface 114 upon which the light indicators 116-L are affixed. In yet other embodiments, the assembly 104 has a spherical or hemi-spherical shape. Generally, an assembly 104 having more indicating surfaces 114 is better, offering a wider range of viewing directions. However, additional indicating surfaces 114 require additional light indicators 116-L, resulting in higher power consumption. As a result, preferred embodiments of the assembly 104 have as many indicating surfaces 114 as are sufficient to provide the desired range of viewing directions around the signaling device 102 without consuming excessive power.

One benefit of the segmented assembly 104 is the ability to customize the different segments 106, 108, 110, 112 for use in different contexts. In particular, the same driver segment 106, sound segment 110, and diagnostic segment 112 can be used with different light segments 108 of varying lengths (along the axis 150) and/or can be used with different numbers of light segments 108 in order to provide more or fewer light indicators 116-L depending on the situation. Similarly, in some embodiments, the light segments 108 use light indicators 116-L that are prebuilt flexible and/or rigid signaling light columns of LED pixels, which are available in a variety of different sizes and LED densities, allowing further customization of the light segments 106 to accommodate different size requirements in different signaling contexts.

Figure 1B:
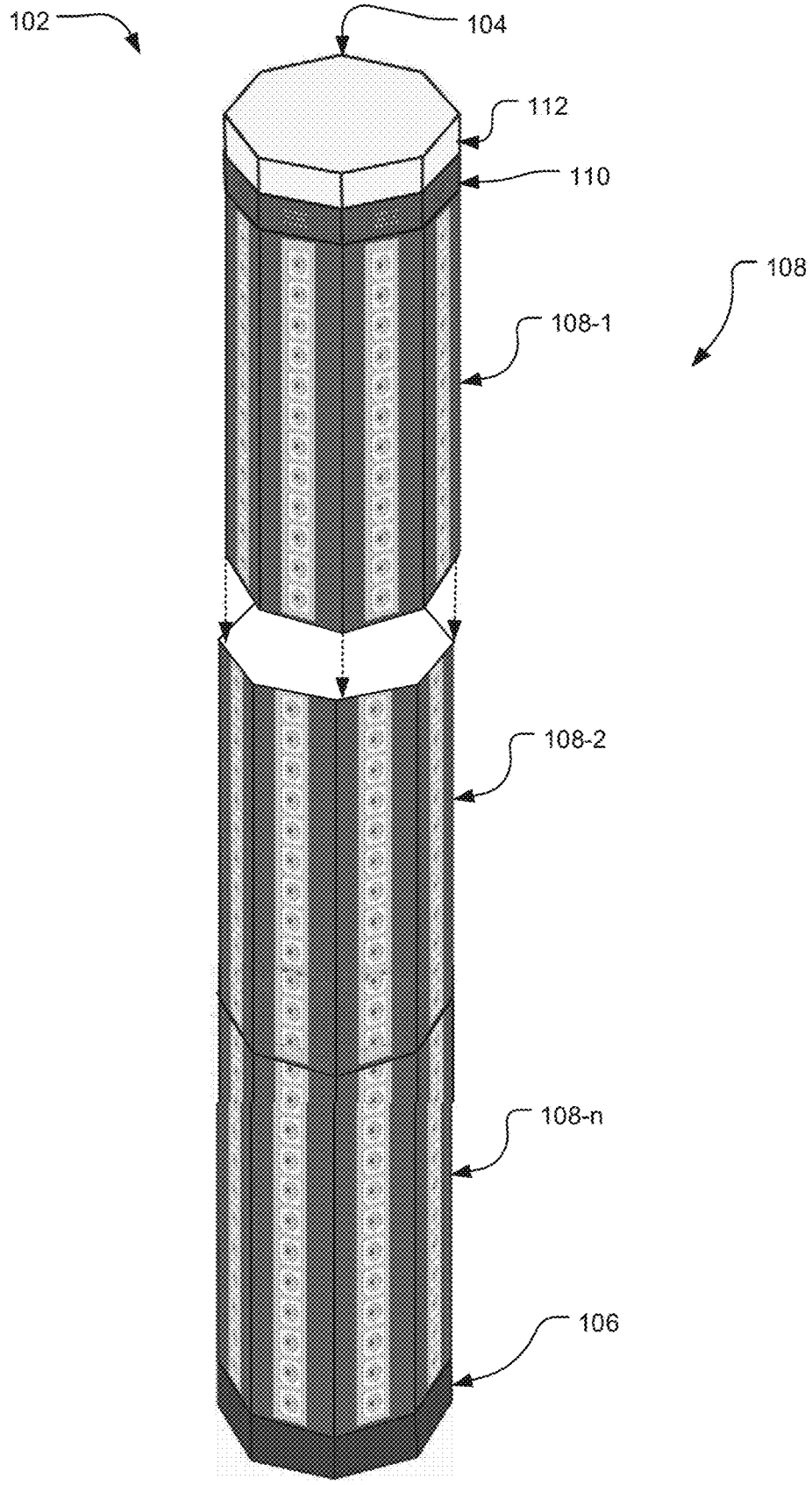
FIG. 1B is a perspective view of the signaling device according to another configuration in which the assembly includes multiple light segments.
Figure 1C:
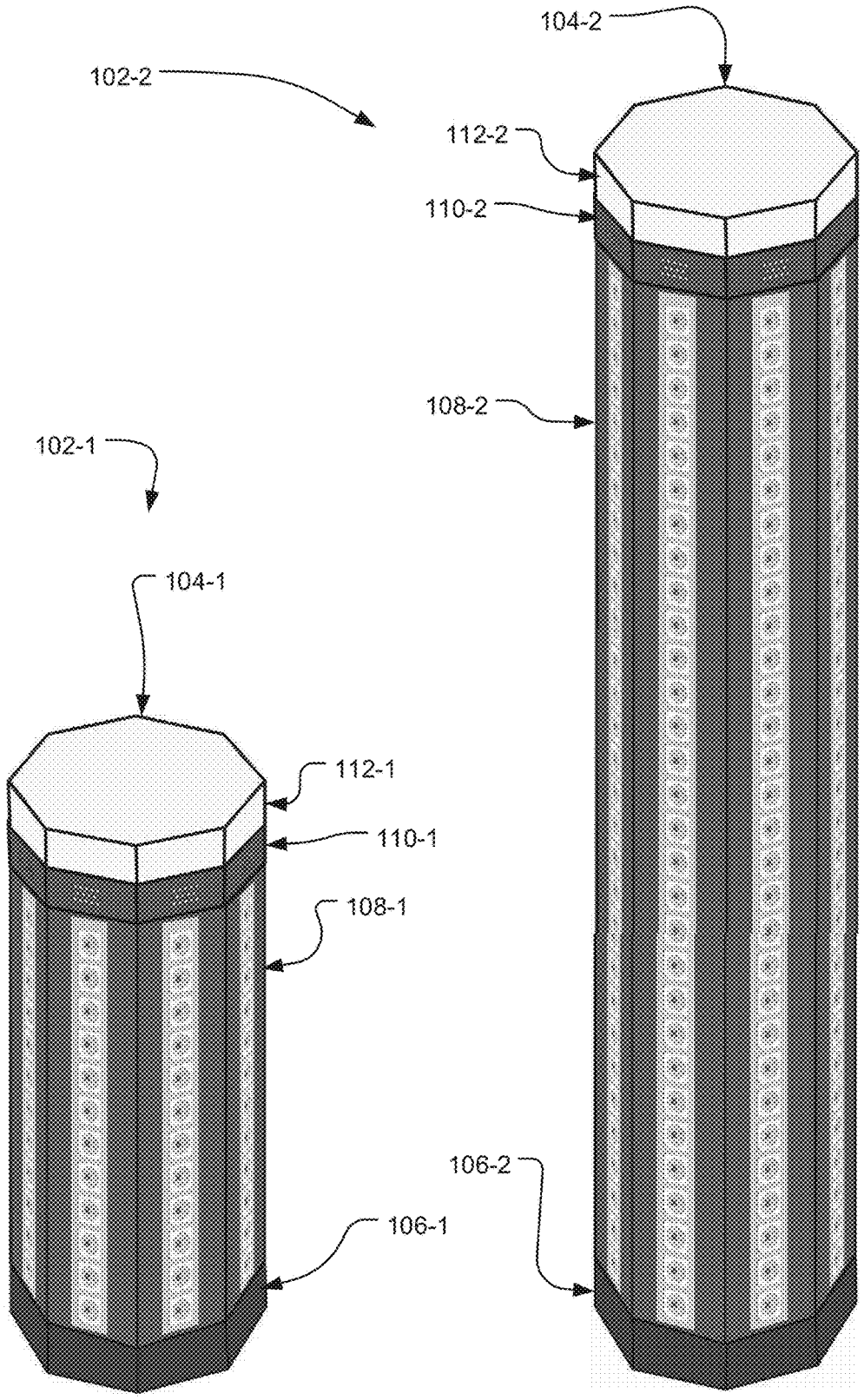
FIG. 1C is a perspective view of two exemplary signaling devices according to another configuration in which assemblies use variably sized light segments.

FIGS. 1B and 1C illustrate how the signaling devices 102 can be customized by varying the segments 106, 108, 110, 112 used in the assembly 104. For the purpose of clarity, only the assemblies 104 and segments 106, 108, 110, 112 of the devices are labeled. However, it should be noted that the signaling devices 102 depicted in FIGS. 1B and 1C have the same mechanical features as the device depicted in FIG. 1A except where the differences between the devices are noted.

FIG. 1B is a perspective view of an exemplary signaling device 102 according to another configuration.

The signaling device 102 is similar to the device previously described with respect to FIG. 1A.

Now, however, in addition to the driver segment 106, sound segment 110 and diagnostic segment 112, the assembly 104 includes a plurality of light sub-segments 108-1 through **108-*n* which connect to form a longer aggregate light segment 108 for the device, for example, providing more light indicators 116-L than the device depicted in FIG. 1A. In this way, the axial length of the aggregate light segment 108** for the device is customizable.

FIG. 1C is a perspective view of two exemplary signaling devices 102 according to another configuration.

Both of the signaling devices 102-1 and 102-2 are similar to the device previously described with respect to FIG. 1A.

However, the two signaling devices 102 have light segments 108 of different axial lengths. Specifically, the signaling device 102-1 includes an assembly 104-1 with a light segment 108-1 with a shorter axial length, and the signaling device 102-2 includes an assembly 104-2 with a light segment 108-2 with a longer axial length, with respect to each other. In this way, the axial length of the light segment 108 for the device is customizable.

Figure 2A:
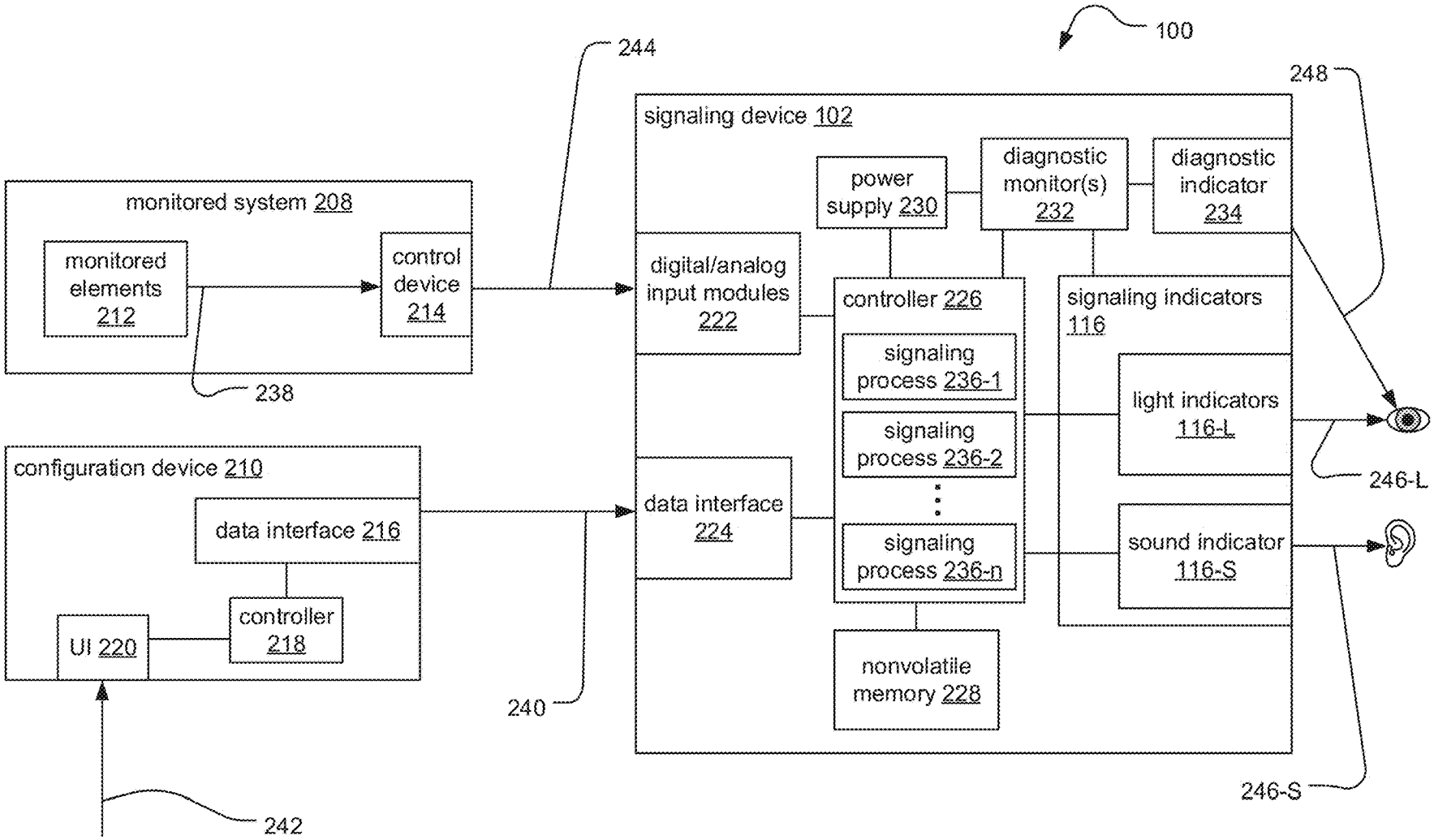
FIG. 2A is a schematic diagram of a signaling system according to one embodiment of the invention.

FIG. 2A is a schematic diagram showing the universal programmable optic/acoustic signaling system 100 at a high level. Specifically, the illustrated example shows how the signaling device 102 interacts with the monitored system 208 and the configuration device 210.

The signaling system 100 includes a signaling device 102, a monitored system 208, and a configuration device 210.

As previously described, the monitored system 208, in different embodiments, is an industrial production line, utility vehicle or other machine, construction site, highway system, hospital, chemical plant, or electrical distribution system, to list a few examples.

The monitored system 208 includes monitored elements 212 and a control device 214.

During normal operation of the monitored system 208, the monitored elements 212 generate internal status information 238 pertinent to the monitored system 208, including detected conditions (e.g. measurements or sensor data indicating physical capacity, pressure, temperature, fluid volume), machine or system status (e.g. state information indicating fault conditions), operational status (e.g. whether the monitored system is in an emergency state), security and/or safety procedures (e.g. restricted areas, behaviors or actions), user input, commands, or instructions, and generally information about any urgent or potentially dangerous situations within or affecting the monitored system 208, to name a few examples. In examples, the monitored elements 212 are generally components of the monitored system 208, including objects, devices, machines, locations, environments, individuals, passageways, or access points, for example.

The control device 214 is generally a computing device of the monitored system 208 that receives the internal status information 238 from the monitored elements 212, generates digital and/or analog control signals 244 based on the status information 238 and sends the control signals 244 encoding the status information to the signaling device 102. In examples, the control device 214 is a desktop computer, laptop computer, mobile computing device such as a smart phone, or tablet computer, and/or a specialized machine or device configured to perform functionality related to the monitored system 208 as well as generate and send the control signals 244 such as a robot arm for an industrial production line or a sensor unit.

The control signals 244 represent the status information 238, including analog and/or digital values associated with the internal status information 238 generated by the monitored elements 212.

The configuration device 210 is a computing device comprising, for example, a user interface (UI) 220, a controller 218, and a data interface 216 (e.g. serial output port). The configuration device 210 receives user input 242 via the UI 220 indicating desired configuration settings and/or functionality of the signaling device 102 from a user or technician configuring the signaling device 102. The controller 218 generates signaling instructions 240 based on the user input 242 and sends the signaling instructions 240 to the signaling device 102 via the data interface 216.

In general, the signaling instructions 240 dictate how the signaling device 102 presents the status information 246 based on the control signals 244 received from the monitored system 208. In one embodiment, the signaling instructions 240 include machine-executable instructions, configuration data, pixel maps including pixel data indicating color and illumination states for each pixel 118, and/or animation scripts indicating sequences of changing color patterns and sounds, among other examples. In one example, the pixel maps include a representation of all of the addressable pixels 118 for each of the light indicators 116-L spanning the entire chain and thus spanning all of the indicating surfaces 114. In this way, the pixel map indicates the display state from every viewing direction (e.g. 360 degrees around the signaling device 102). In another example, the animation scripts indicate an animation sequence starting when a specific control event is detected (e.g. via the control signals 244) and is looped until the event stops or is replaced by a higher priority event (or control signal). In this example, each signaling event has an associated script.

In general, the signaling device 102 receives the control signals 244 from the monitored system 208 and the signaling instructions 240 from the configuration device 210 and presents the status information 246 to observers within or pertinent to the monitored system 208 based on the control signals 244 and signaling instructions 240. In one example, each of the control signals 244 represent one of a range of different statuses for the monitored system 208, while the signaling instructions 240 represent different actions to be performed (e.g. sound or light sequences to present) associated with each of the different control signals 244.

The signaling device 102 includes a controller 226, a power supply 230, one or more digital/analog input modules 222, a data interface 224 (e.g. serial port), nonvolatile memory 228, one or more diagnostic monitors 232, a diagnostic indicator 234, and signaling indicators 116, including one or more light indicators 116-L and sound indicators 116-S.

In general, the power supply 230 provides power to the controller 226, one or more of the diagnostic monitors 232, and/or the signaling indicators 116. In one embodiment, the power supply 230 converts electric current from a source power circuit (e.g. 24 V dedicated signaling power circuit, or mains power at 120, 230 or 240 Volts (V)) to an operating voltage (e.g. 5 V), current and frequency to power the signaling device 102.

The digital/analog input modules 222 receive the digital/analog control signals from the monitored system 208 and send the control signals to the controller 226. In one embodiment, the input modules 222 are capable of receiving both digital and analog control signals and appropriately outputting the control signals to the controller 226 based on whether the incoming signals are digital or analog. In another embodiment, the input modules 222 are configured for either digital or analog input.

In general, data interface 224 is used for updating software on the signaling device 102 and/or for receiving control signals 244 from a wired and/or wireless network. The data interface 224 receives the signaling instructions 240 from the configuration device 210 and relays the signaling instructions to the controller 226. In embodiments, the data interface 224 is a serial port according to standards such as Ethernet, USB, and/or RS-232, among other examples.

The nonvolatile memory 228 generally stores information used by the signaling processes 236 and/or the controller 226 including firmware instructions, configuration information for the signaling device 102, machine-executable instructions (e.g. based on the signaling instructions 240 received from the configuration device 210) for executing the signaling processes 236, pixel maps for the light indicators 116-L including pixel data, and/or animation scripts, among other examples.

In general, the controller 226 directs functionality of the signaling device 102, for example, by executing firmware and/or software instructions. In one example, the controller 226 is small single-board computer. In other examples, the controller 226 is a microcontroller unit or a system on a chip (SoC), including one or more processor cores along with memory and programmable input/output peripherals such as analog to digital converts and digital to analog converters. More specifically, the controller 226 receives the signaling instructions 240 from the configuration device 210 and drives the signaling indicators 116, for example, by executing one or more signaling processes 236-1 through **236-*n* based on the signaling instructions 240. The signaling processes 236 direct the signaling device's 102 behavior in response to different control signals 244 from the monitored system 208. In one example, a signaling process 236 executing on the controller 226 receives a particular control signal 244, generates display instructions based on the control signal 244, and sends the display instructions to the light indicators 116-L. In another example, the signaling process 236 executing on the controller 226 receives a particular control signal 244 and drives the sound indicator 116-S based on the particular control signal. The controller 226 also executes diagnosis processes, for example, by determining the diagnostic status based on input from the diagnostic monitors 232 and/or components with embedded diagnostic monitors 232**, generating diagnostic data and including the diagnostic data with the display instructions.

In general, the indicators 116 present the status information 246.

The light indicators 116-L present the status information 246-L by emitting light. In one embodiment, the light indicators 116-L are LED strings that collectively form an LED screen distributed across the indicating surfaces 114 of the light section 108 of the assembly 104. Each of the LED strings 116-L is mounted to a different indicating surface 114. The LED strings 116-L from each of the different indicating surfaces 114 are connected in sequence, forming a chain of LED strings 116-L. In turn, each of the LED strings 116-L comprises a plurality of addressable pixels 118, which are, for example, individual LEDs that emit light in different colors based on display instructions received from the controller 226.

The sound indicators 116-S present the status information 246-S by emitting sound. In one embodiment, the sound indicator 116-S is a piezoelectric speaker comprising a piezoelectric element or material to which a voltage is applied, generating the sound.

In general, the diagnostic monitors 232 determine a diagnostic status for the signaling device 102, for example, according to results of a series of self-tests performed by the diagnostic monitors 232 and/or the controller 226. The diagnostic monitors 232 are hardware modules that are connected to and/or embedded within other components of the signaling device 102 including the light indicators 116-L, the sound indicator 116-S, the input modules 222. The diagnostic monitors 232, in combination with the controller 226, determine the diagnostic status of the input modules 222, power supply 230, LED strings 116-L, addressable pixels 118 (e.g. individual LEDs), the controller 226, and the sound indicator 116-S.

The diagnostic indicator 234 presents diagnostic information 248 for the signaling device 102, for example, by emitting light based on the diagnostic status of the device as determined via the diagnostic monitors 232. In one example, the diagnostic indicator 234 steadily emits light to indicate that the signaling device 102 is functioning normally. In another case, the diagnostic indicator emits light, such as a flashing light, when the signaling device 102 has lost connection with the monitored system.

Figure 2B:
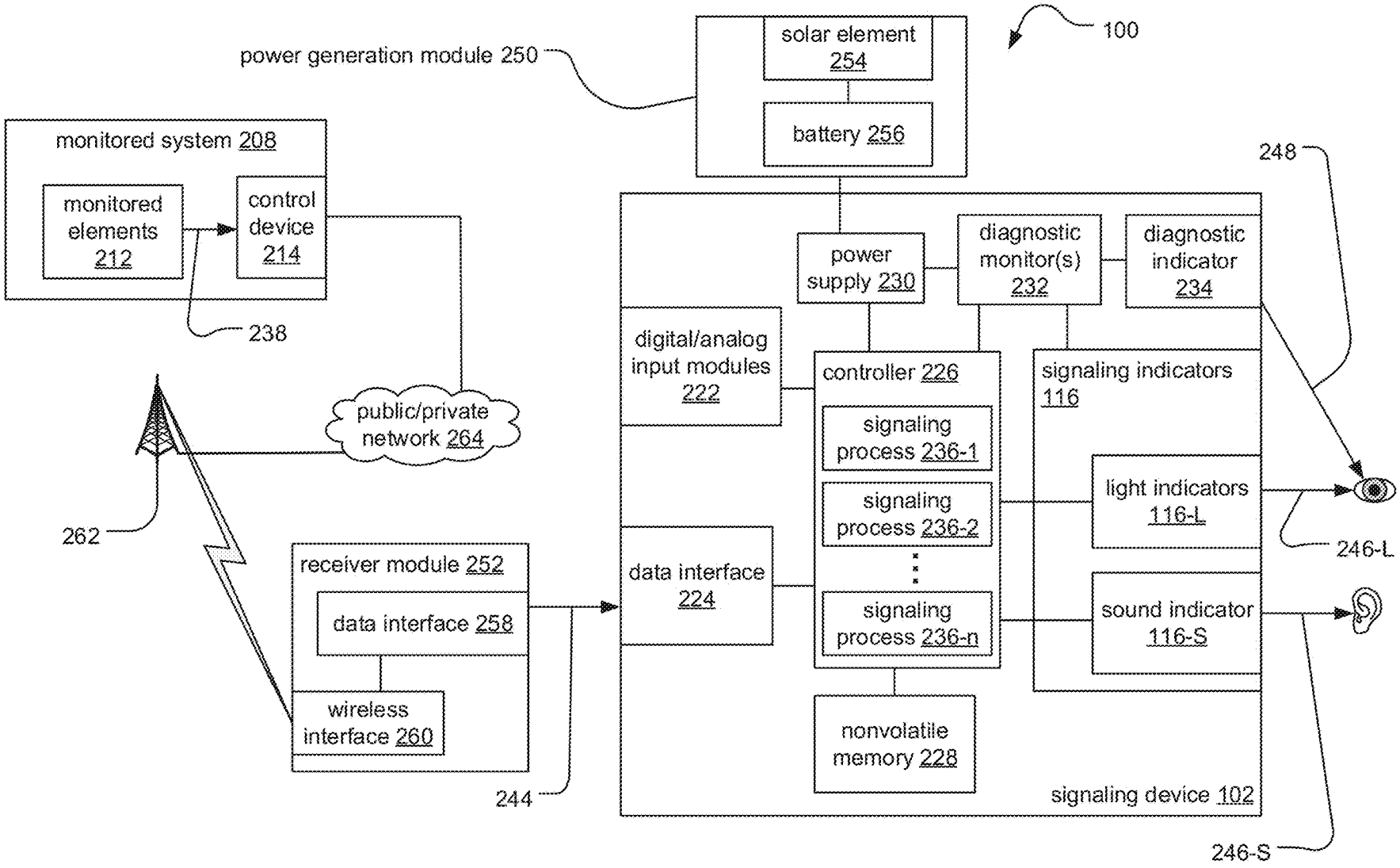
FIG. 2B is a schematic diagram of the signaling system according to another embodiment of the invention.

FIG. 2B is a schematic diagram showing the universal programmable optic/acoustic signaling system 100 according to a configuration in which the signaling device 102 is powered via solar power and wirelessly receives the control signals 244.

The signaling device 102 is similar to the one described with respect to FIG. 2A.

Now, however, the signaling device 102 includes a power generation module 250 and a receiver module 252.

The power generation module 250 powers the signaling device 102. More specifically, the power generation module 250 comprises a solar element 254 and a battery 256. The solar element 254 converts sunlight into electricity. In one embodiment, the solar element 254 is a photovoltaic system employing solar panels/cells and/or conductors that generate the electricity according to the photovoltaic effect. The battery 256 stores backup power for powering the signaling device 102, for example, when sunlight is not available.

The control device 214 of the monitored system 208 and the receiver module 252 are both connected to a public and/or private network 264, such as the internet or a private wide area network, among other examples. The receiver module 252 connects to the public and/or private network 114 via a wireless communication link to a wireless access point such as a cellular radio tower 262 of a mobile broadband or cellular network and/or via a private data network providing connectivity with the public and/or private network 114 such as an enterprise network, Wi-Max, or Wi-Fi network, for example, or according to a low-power wireless communication protocol such as Long Range (LoRa), narrowband IoT (NB IoT) and/or LTE Cat M1, among other examples.

The control device 214 sends the control signals to the receiver module 252 via the public and/or private network 264, and the receiver module 252 wirelessly receives the control signals 244 via a wireless interface 260 and relays the control signals 244 to the signaling device 102 via the a data interface 258.

In this embodiment, the signaling device 102 is an independently powered device with battery backup and radio communication to the monitored system 208, which is used, for example, to provide disaster warnings, or for highway traffic and/or events signaling, among other examples.

Several applications of the signaling system 100 and signaling device 102 are possible.

In one example, the monitored system 208 is an industrial production line, and the signaling device 102 is used to signal line state or operation errors.

In another example, the monitored system 208 is a utility vehicle or a construction site, and the signaling device 102 is used to signal different operation modes.

In another example, the monitored system 208 is an environment (e.g. outdoor environment or large geographical area), and an independently powered and remotely located embodiment of the signaling device 102 comprising the power generation module 250 and the receiver module 252 is used to signal natural disasters or weather events.

In another example, the monitored system 208 is a traffic or roadway system, and the independently powered and wireless-capable signaling device 102 is used to signal traffic conditions and events.

In another example, the monitored system 208 is a hospital, and the wireless- and/or network-capable signaling device 102 is used to signal emergencies to a team of doctors and health care professionals.

In yet another example, the monitored system 208 is a chemical plant, and the signaling device 102 is used to visually monitor process parameters and indicate malfunction warnings and/or parameters outside defined limits.

Figure 3:
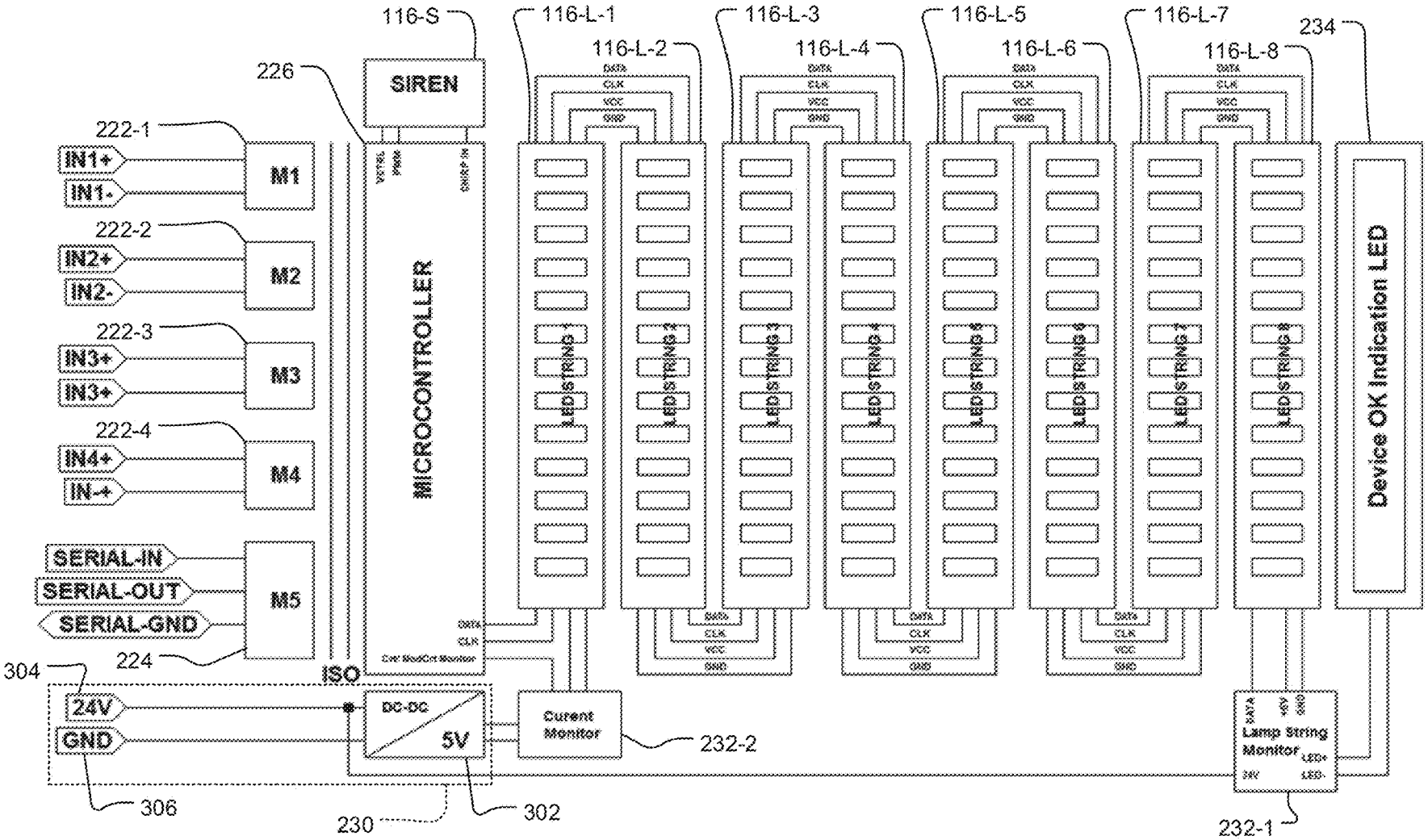
FIG. 3 is a circuit diagram of the signaling device according to one embodiment of the invention.

FIG. 3 is a circuit diagram of the signaling device 102 according to one embodiment of the invention. As previously described, the signaling device includes the controller 226, the input modules 222, the data interface 224, the sound indicator 116-S, the power supply 230, a series of light indicators 116-L, and diagnostic monitors 232.

Now, however, the components are shown in more detail.

Two diagnostic monitors are depicted, including a lamp string monitor 232-1 and a current monitor 232-2.

Four input modules 222 and the data interface 224 are also depicted, which are insulated to accommodate control signals 244 from various sources. In one example, the first two input modules 222-1 and 222-2 are configured as analog (4-20 milliamps (mA)) or digital (e.g. accommodating logic voltages up to 24V), while the second two input modules 222-2 and 222-3 are configured as purely digital inputs.

The power supply 230 includes a power input 304, a ground output 306, and a high efficiency DC-DC switching regulator 302. A power circuit providing power to the power supply 230 delivers current to the power supply 230 via the power input 304 (e.g. at 24 V), which is returned to the source via the ground output 306. The incoming power is directed to the lamp string monitor 232-1 and to the regulator 302 in parallel. The regulator 302 converts the incoming power to 5 V and relays the converted power to the current monitor 232-2.

Eight LED strings 116-L-1 through 116-L-8 are connected in sequence. The power supply 230 provides power to the first LED string 116-L-1 via the current monitor 232-2, while the controller 226 is connected to the first LED string 116-L-1 via a data connection and a clock connection for sending the display instructions. The power and display instructions are successively relayed through each of the LED strings 116-L-1 through 116-L-8 via these respective connections. The terminal LED string 116-L-8 outputs the power and display instructions to the lamp string monitor 232-1.

The current monitor 232-2 is an auxiliary diagnostic monitor 232 that measures the current consumed by the LED strings 116-L and sends the measured current to the controller 226, which determines whether the measured current indicates that one of the addressable pixels 118 is damaged, for example.

The lamp string monitor 232-1 is the primary diagnostic monitor 232 and drives the diagnostic indicator 234 based on the diagnostic status of the signaling device 102. For example, the lamp string monitor 232-1, which receives power independently from the power supply 230, drives the diagnostic indicator 234 to steadily emit light in response to receiving adequate power from the power supply 230, while the diagnostic indicator 234 does not emit light if the power is missing. In this way, the lamp string monitor 232-1 drives the diagnostic indicator 234 to communicate diagnostic information 248 indicating the power status of the signaling device 102. Additionally, the lamp string monitor 232-1 drives the diagnostic indicator 234 (e.g. by modulating the light emitted by the diagnostic indicator 234) based on the data relayed from the terminal LED string 116-L-8.

In one example, the lamp string monitor 232-1 drives the diagnostic indicator 234 based on whether the display instructions (e.g. including a predetermined diagnostic sequence attached to the end of every active frame) are successfully transmitted across the light indicators 116-L to the lamp string monitor 232-1. Here, the lamp string monitor 232-1 processes the diagnostic data and, if the data is present, drives the diagnostic indicator 234 to emit light. On the other hand, if the lamp string monitor 232-1 determines that the diagnostic data is not present for a predetermined period of time, the lamp string monitor 232-1 turns off the diagnostic indicator 234. The controller 226 continually refreshes the display information, including updated diagnostic data reflecting the current diagnostic status, at a predetermined minimum refresh rate. In this way, the signaling device 102 is self-diagnosed on a continuous basis. For example, if the controller 226 malfunctions or hangs, failing to send the display instructions and/or diagnostic data, the lamp string monitor 232-1 turns off the diagnostic indicator 234 based on not receiving the diagnostic data according to the minimum refresh rate.

In another example, the controller 226 modulates the inclusion of the diagnostic data in the display instructions (e.g. by intermittently sending iterations of the display instructions with the diagnostic data and otherwise not including the diagnostic data), causing the lamp string monitor 232-1 to drive the diagnostic indicator 234 to modulate the light emitted according to the modulated inclusion of the diagnostic data. The controller 226 includes the diagnostic data with the display instructions at a higher frequency (e.g. 0.5 seconds (s) on, 0.5 s off) in order to indicate a sound indicator 116-S fault, causing the lamp string monitor 232-1 to drive the diagnostic indicator 234 to indicate the sound indicator fault 116-S by modulating the emitted light at a frequency proportional to the frequency with which the diagnostic data was included with the display instructions. On the other hand, the controller 226 includes the diagnostic data with the display instructions at a lower frequency (e.g. 2 s on, 2 s off) in order to indicate an input module 222 fault, causing the lamp string monitor 232-1 to drive the diagnostic indicator 234 to indicate the input module 222 fault by modulating the emitted light at a proportional frequency. The controller 226 does not include the diagnostic data with the display instructions to indicate a damaged pixel 118, causing the lamp string monitor 232-1 to turn off the diagnostic indicator 234 in order to indicate the pixel 118 fault.

In another example, the lamp string monitor 232-1 drives the diagnostic indicator 234 based on values of diagnostic data included with the display instructions by the controller 226, the diagnostic data indicating the diagnostic status of the input modules 222, sound indicator 116-S, and LED strings 116-L, as determined via diagnostic monitors embedded within the respective components and/or via the current monitor 232-2.

Figure 4:
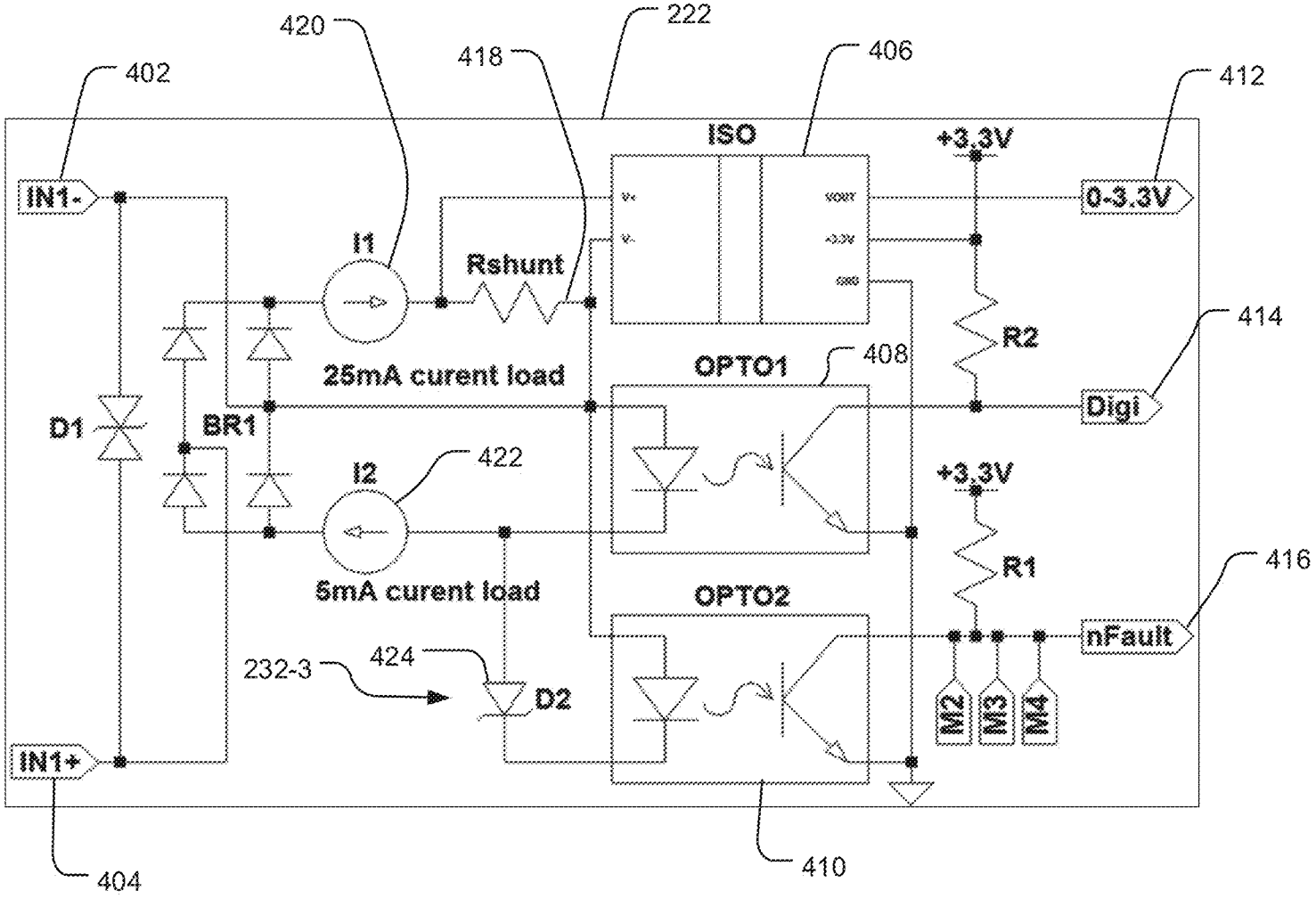
FIG. 4 is a circuit diagram of an exemplary input module of the signaling device.

FIG. 4 is a circuit diagram of an exemplary input module 222 with dual analog and digital functionality.

In general, the input module 222 achieves a combined analog/digital input functionality by relying on the fact that insulated input should be floating (e.g. any input terminal can be a ground for the input circuitry). The input module 222 receives control signals having one of a first polarity and a second polarity and is configured to automatically process control signals with the first polarity as analog control signals and automatically process control signals with the second polarity as digital control signals.

The input module 222 includes a first input 402, a second input 404, a 25 mA current load 420, a shunt 418, an isolation amplifier 406, a digital optical isolation amplifier 408, an analog output 412, and a digital output 414. The input module 222 also includes embedded diagnostic monitor elements 232-3, including a fault optical isolation amplifier 410, a Zener diode, and a fault output 416.

When the input received via the first and second inputs 402, 404 are direct biased (e.g. having the first polarity, or when the voltage of the second input 404 is greater than the voltage of the first input 402, and the current is direct in via the second input 404 and returned to the source via the first input 402), the input module 222 receives the input (e.g. from the monitored system 208) as an analog (4-20 mA) current. More specifically, the current is directed to an upper branch of the input module 222 circuitry and is limited by the current load 420 to 25 mA. The input is evaluated via the shunt 418 and transmitted as output voltage through the isolation amplifier 406 to an analog-to-digital converter (ADC) input of the controller 226 via the analog output 412. In this case, any input that is out of boundaries (e.g. lower than 4 mA and greater than 20 mA) and converted to voltage and received and evaluated by the controller 226 is considered as an input fault.

On the other hand, when the input received via the first and second inputs 402, 404 is reversed biased (e.g. having the second polarity, or when the voltage of the first input 402 is greater than the voltage of the second input 404, and the current is directed in via the first input 402 and returned to the source via the second input 404) the input works as voltage digital input. In this case, the current is directed to a second branch of the input module 222 circuitry, and the input current is limited to 5 mA by the current load 422 and fed to the digital optical isolation amplifier 408 when the input is in a high state (e.g. 5V to 24V) which turns the digital optical isolation amplifier 408 output to a low state (e.g. representing a digital signal), which is output to the controller 226 via the digital output 414. Because of a Zener diode 424 in series with the fault optical isolation amplifier 410, the fault optical isolation amplifier 410 is not biased because the internal LED dropping voltage of the digital optical isolation amplifier 408 limits the input voltage to the fault optical isolation amplifier 410 circuitry. If the internal LED fails (e.g. causing an open circuit), the fault optical isolation amplifier 410 will be biased and output a low state, which is output to the controller 226 via the fault output 416.

All of the input modules 222 output fault signals to the controller 226 via the fault output 416, which is common to all of the modules. Any input that fails across all of the modules 222 generates a fault signal.

Figure 5:
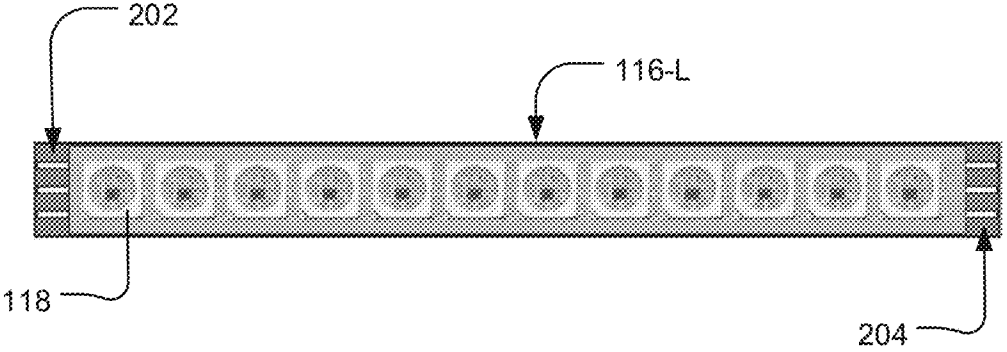
FIG. 5 is a schematic diagram of a light indicator of the signaling device according to one embodiment.
Figure 6:
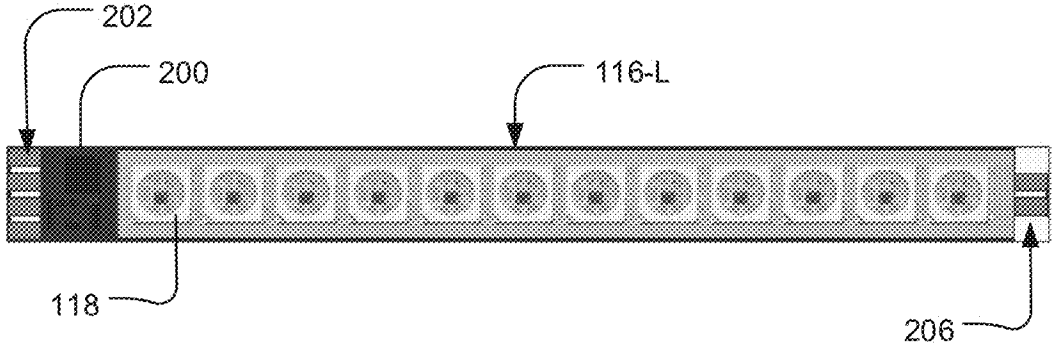
FIG. 6 is a schematic diagram of the light indicator according to another embodiment.

FIGS. 5 and 6 show different embodiments of the light indicators 116-L, particularly LED strings. As previously described, each of these LED strings 116-L are mounted to an indicating surface 114 of the light section 108 of the assembly 104. The LED strings 116-L from each of the different indicating surfaces 114 are connected in sequence, forming a chain of LED strings 116-L, with each LED string 116-L comprising a series of addressable pixels 118.

FIG. 5 is a schematic diagram of the LED string 116-L light indicator, according to one embodiment in which a common power supply 230 (for example, housed in the driver section 106 of the assembly 104) powers a primary LED string 116-L, which then relays the power to a subsequent LED string 116-L, which each LED string 116-L relaying power to the subsequent LED string 116-L.

The LED string 116-L includes power and communication input connectors 202, a series of addressable pixels 118, and power and communication output connectors 204.

In general, the input connectors 202 and output connectors 204 are metalized terminals at either end of the LED string 116-L.

The LED string 116-L receives power and display instructions from either the driver section 106 components (e.g. the controller 226 and the power supply 230) or from a previous LED string 116-L in the chain of LED strings 116-L via the input connectors 202. In one embodiment, the LED string 116-L includes two input connectors 202 for receiving the power (e.g. a ground connector and a VCC connector) and two input connectors 202 for receiving the display instructions (e.g. a data connector and a clock connector).

The LED string 116-L relays the power and display instructions to the subsequent LED string 116-L in the chain via the power and communication output connectors 204, which are configured to conform with the configuration of the input connectors 202 (e.g. with ground, VCC, data and clock output connectors 204).

In this example, the power received by the primary LED string 116-L (e.g. the one connected to the power supply 230) is conditioned by the common power supply 230 housed in the driver section 106. The power supply 230 converts an input voltage (e.g. 24 Volts (V)) received from a power source to a voltage used by the LED string 116-L. Similarly, the current consumed by the entire chain of LED strings 116-L is measured by a common current monitor 232-2 housed in the driver section 106.

FIG. 6 is a schematic diagram of the LED string 116-L light indicator, according to another embodiment in which each of the LED strings 116-L includes a driver section 200 for powering the LED string 116-L and measuring the current consumed by the individual LED string 116-L.

The LED string 116-L is similar to the one described with respect to FIG. 5.

Now, however, the LED string 116-L includes a driver 200 and communication output connectors 206.

The LED string 116-L receives the power and the display instructions via the power and communication input connectors 202. The power is provided directly from the power supply 230 (even if it is in a middle or end portion of the chain of LED strings 116-L), while the display instructions are received from the controller 226 or from the previous LED string 116-L in the chain.

The driver 200 conditions the received power, for example, by converting the input voltage (e.g. 24 V) received directly from the power supply 230 via the input connectors 202 to a voltage used by the LED string 116-L. The driver 200 also measures the current consumed by the individual LED string 116-L.

This embodiment of the LED string 116-L is especially useful when a large number of LED strings 116-L and pixels 118 are required, for example, because it provides better distributed heat dissipation.

Figure 7:
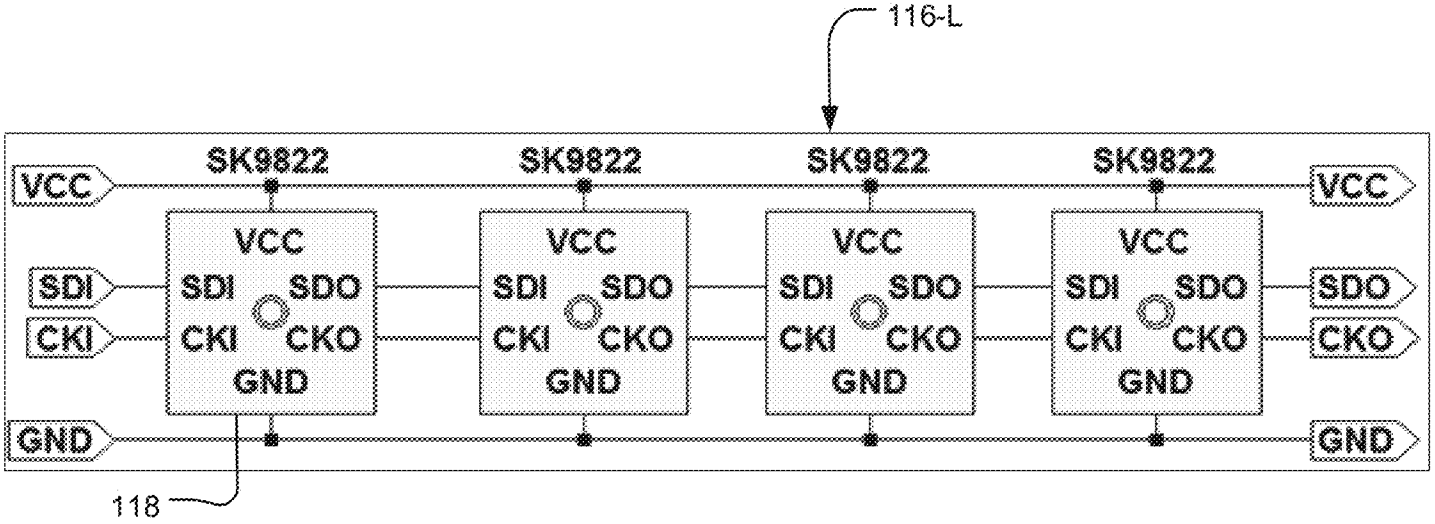
FIG. 7 is a circuit diagram of the light indicator according to one embodiment.

FIG. 7 is a circuit diagram of the LED string 116-L according to one embodiment of the invention in which the LED strings 116-L are implemented according to the APA102/SK9822 communication standard, which uses VCC, ground, data, and clock inputs and outputs to drive the LED pixels.

In one example, each pixel 118 is a synchronous or asynchronous digital LED. Synchronous LEDs require data and clock signals (e.g. to emulate an SPI communication) and allows a high-speed refresh. The asynchronous LEDs use only data for chaining and have a lower refresh rate.

In either case, the first LED in the chain receives a first chunk of pixel data, then passes the rest to the next element (e.g. LED, LED string 116-L, lamp string monitor 232-1). A special sequence is used to indicate a new display frame or display state or to refresh the pixel 118. Any of previously described types of digital LEDs can be used to implement the signaling device 102. Additionally, other implementations of LED strings 116-L can use discrete RGB LEDs and a driver circuit that can be chained (like TLC5947, which can drive 8 RGB LEDs).

Figure 8:
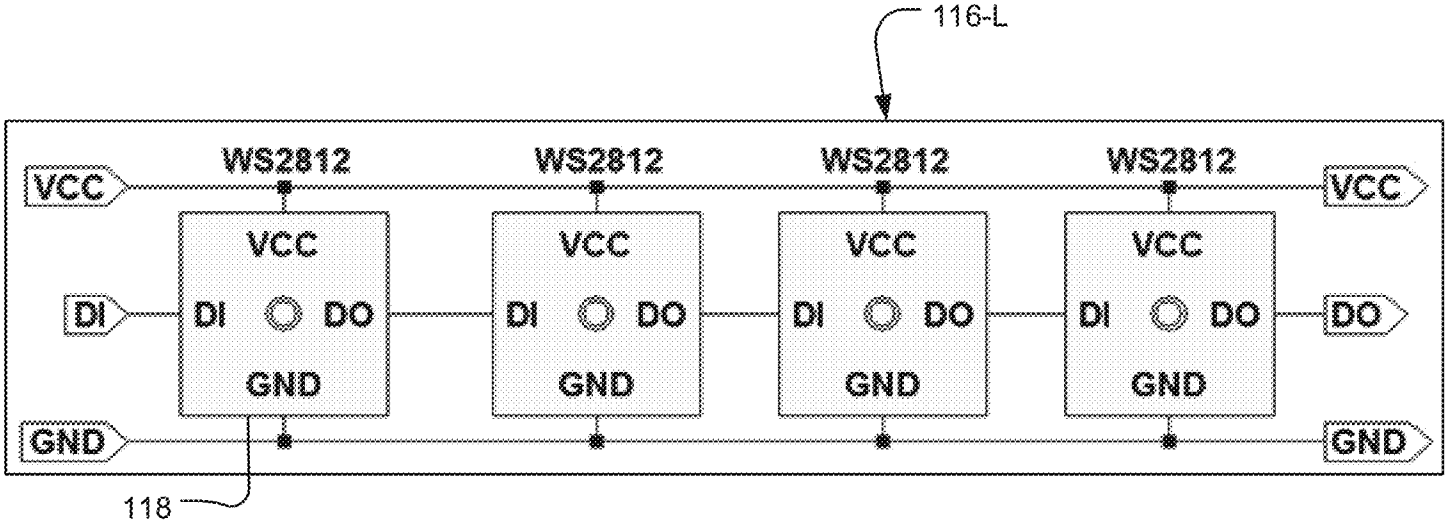
FIG. 8 is a circuit diagram of the light indicator according to another embodiment.

FIG. 8 is a circuit diagram of the LED string 116-L according to another embodiment of the invention in which the LED strings 116-L are implemented according to the WS2812 communication standard, which uses VCC, ground, and data inputs and outputs to drive the LED pixels.

Figure 9:
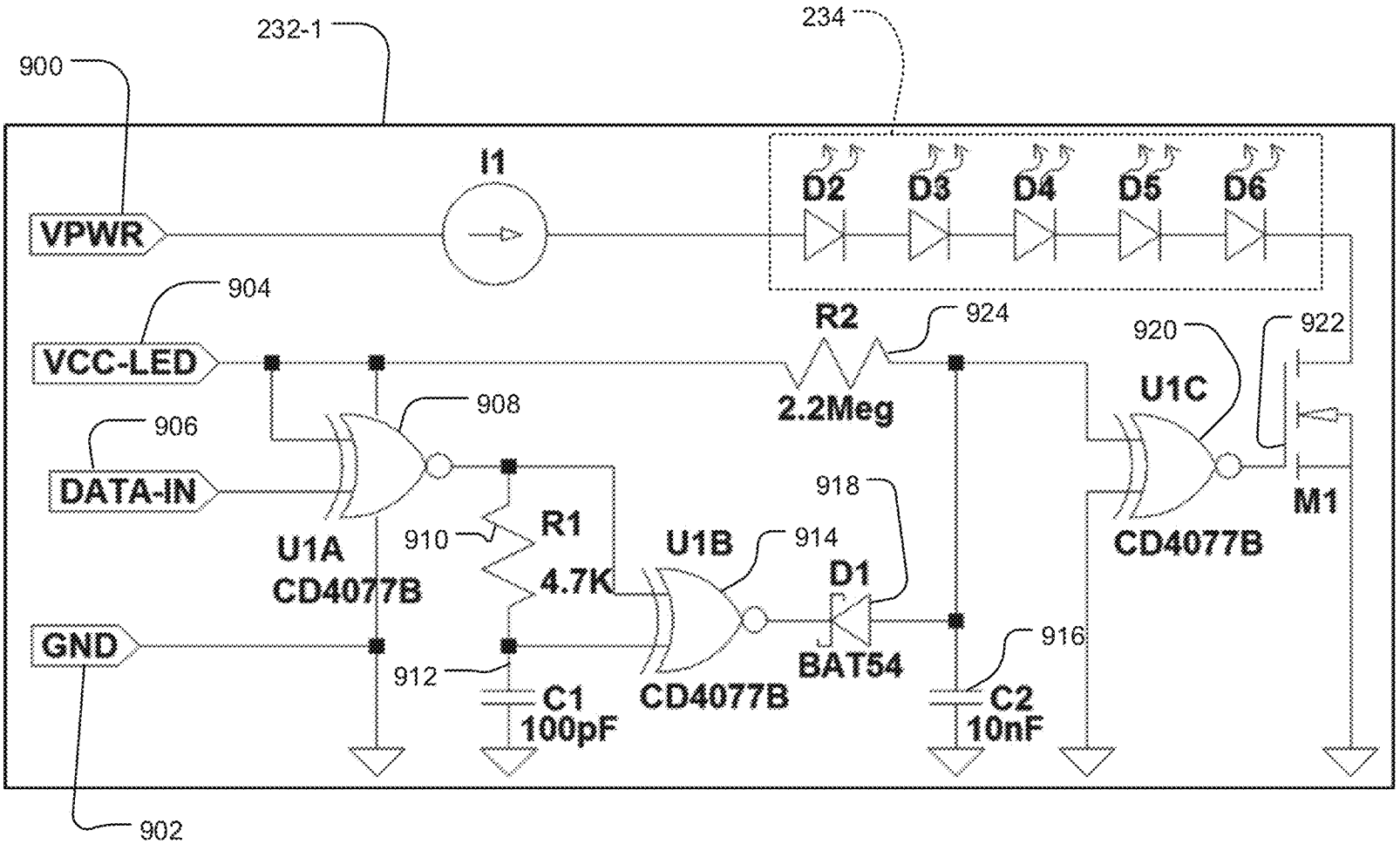
FIG. 9 is a circuit diagram of a lamp string monitor of the signaling device.

FIG. 9 is a circuit diagram of the lamp string monitor 232-1.

The lamp string monitor 232-1 is the primary diagnostic monitor 232 and drives the diagnostic indicator 234, which is shown in the illustrated example as a series of LEDs.

As previously mentioned, in order to drive the LED strings 116-L, the controller 226 generates display instructions including, for example, pixel data such as color information for each pixel 118. The pixel data is serialized, and each pixel 118 (e.g. LED) keeps or consumes a portion of the pixel data (e.g. 4 bytes) and relays the remaining pixel data on to the next pixel 118 and/or the next LED string 116-L. The remaining portions of the pixel data continue to be consumed and relayed onward through the chain of LED strings 116-L and pixels 118 and ultimately to the lamp string monitor 232-1 by the terminal LED string 116-L-8. Assuming that the display instructions includes pixel data for the exact number of pixels 118 present on the signaling device 102, no further data is passed to the lamp string monitor 232-1.

Thus, the controller 226 supplements the display instructions with the diagnostic data. Specifically, the diagnostic data is added as a diagnostic frame at the end of the pixel data such that there is more data than the number of pixels 118 can consume. For each iteration of display instructions (e.g. upon each refresh), the lamp string monitor 232-1 receives any existing trailing diagnostic frame and uses it to drive the diagnostic indicator 234. Whether the LED strings 116-L are presenting the status information 246-L in animation or as steady emitted light (e.g. a solid red color), the controller 226 continuously refreshes and sends the display instructions and thus continuously has the opportunity to send or not send the trailing diagnostic data to the lamp string monitor 232-1. Patterns in which iterations of display instructions include the diagnostic data and which iterations do not are used to drive the diagnostic indicator 234. If the controller 226 continuously sends the display instructions including the trailing diagnostic data, the lamp string monitor 232-1 continuously drives the diagnostic indicator 234 to steadily emit light and thus indicate that the diagnostic status is good. On the other hand, by intermittently including and not including the trailing diagnostic data in the display instructions, the controller 226 causes the lamp string monitor 232-1 to drive the diagnostic indicator 234 to emit pulsed light indicating a diagnostic fault.

In general, the lamp string monitor 232-1 is a missing pulse train detector. Specifically, the lamp string monitor 232-1 detects whether the trailing diagnostic data was included with the display instructions and successfully transmitted across the LED strings 116-L.

The lamp string monitor 232-1 includes a power input 900, a ground output 902, a lamp power input 904, a lamp data input 906, a first XNOR gate 908, a resistor 910, a first capacitor 912, a second XNOR gate 914, a second capacitor 916, a diode 918, a third XNOR gate 920, an NMOS gate 922, and second resistor 924.

The power supply 230 delivers current to the lamp string monitor 232-1 via the power input 900, which is returned to the source via the ground output 902. This current is directed to the diagnostic indicator 234 to power the indicator (e.g. to emit light via one or more LEDs). When the power supply 230 fails to receive/supply adequate power, the diagnostic indicator 234 does not emit light, communicating the power failure state to observers, for example.

The lamp string monitor 232-1 also receives power relayed from the LED strings 116-L via the lamp power input 904, and display instructions (e.g. trailing pixel data and/or diagnostic data) from the LED strings 116-L via the lamp data input 906.

The XNOR gate 908 acts as a buffer for incoming diagnostic data. The second XNOR gate 914, along with the resistor 910 and the capacitor 912 function as a frequency doubler (or a transition detector), in which any transition from a high state to a low state or from a low state to a high state at the input generates a low pulse at the XNOR gate's 914 output. When no transitions are detected in the incoming data the XNOR gate's 914 output remains in the high state. In response to a low output from the second XNOR gate 914, energy stored in the second capacitor 916 is discharged through the diode 918. In this way the input of the third XNOR gate 920 is kept low at all times when the diagnose data or frame is present in the display instructions. As a result, the third XNOR gate 920 output remains high, the NMOS gate 922 is turned on, and a constant current (I1) flows through the diagnostic indicator 234 (e.g. through the indication LEDs D2, D3, D4, D5, D6), emitting steady light.

On the other hand, when the diagnostic data is missing, the output at the XNOR gate 914 is high, and the capacitor 916 begins charging through the second resistor 924. When a predetermined high input threshold for the XNOR gate 914 is achieved, the output turns to the low state, and the LEDs of the diagnostic indicator 234 are turned off. By keeping a minimum refresh rate for receiving the diagnostic data, the capacitor 916 is never charged to the high threshold, and light will continuously be emitted by the diagnostic indicator 234.

For optimum functionality the diagnostic frame needs to be a signal with multiple low/high and/or high/low transitions. For example, if the lamp data input 906 is suspended on a high or low state, the lamp string monitor 232-1 fails to detect transitions in the incoming signal, and the diagnostic indicator 234 is turned off.

Figure 10:
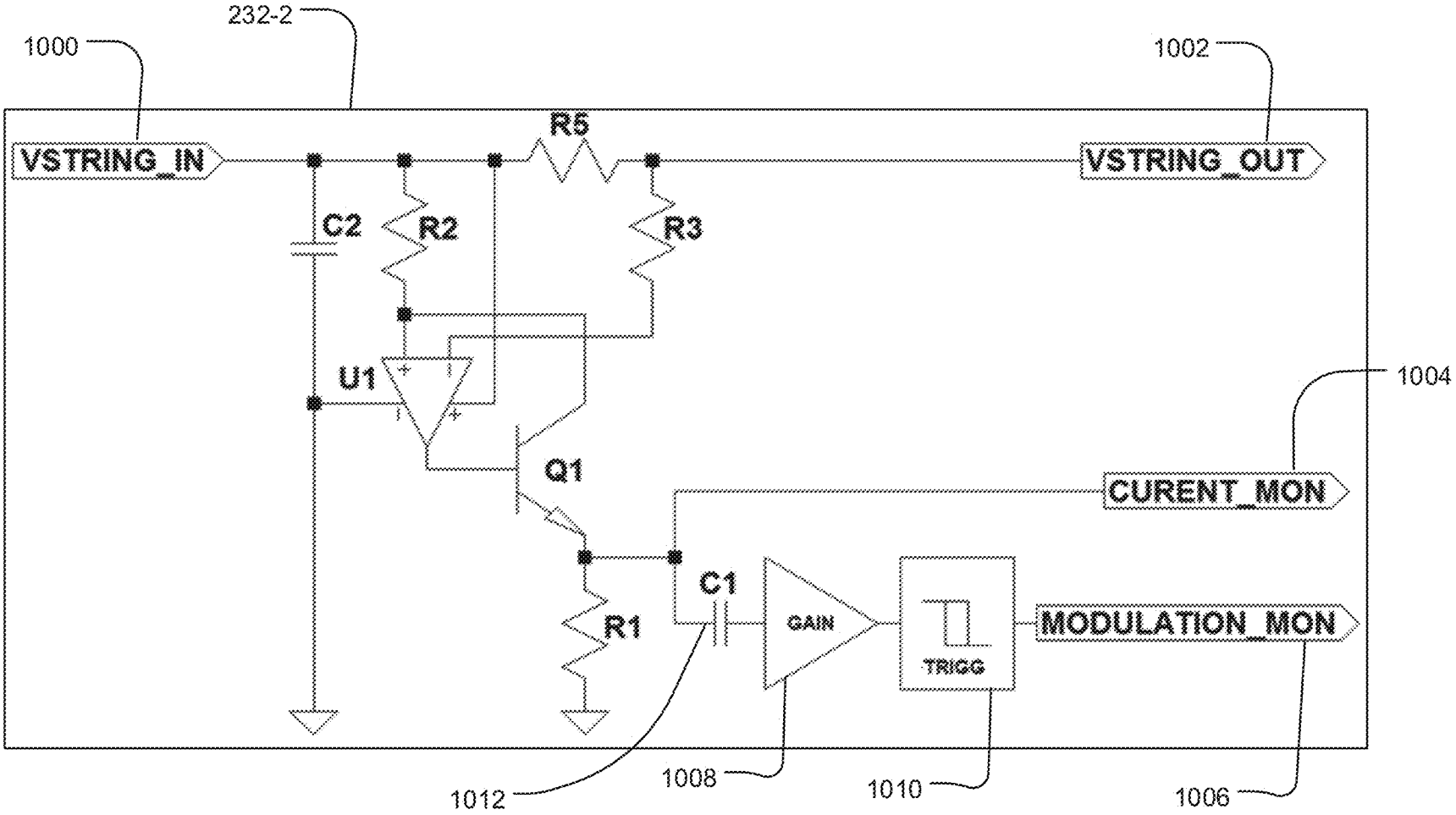
FIG. 10 is a circuit diagram of a current monitor of the signaling device.

FIG. 10 is a circuit diagram of the current monitor 232-2.

The current monitor 232-2 is an auxiliary diagnostic monitor 232 that evaluates an electrical load of a circuit providing power to the light indicators 116-L (e.g. by monitoring the current consumed by the LED strings 116-L and outputting to the controller 226 a signal indicating the evaluated electrical load or measured current).

The current monitor 232-2 includes a lamp power input 1000, lamp power output 1002, a DC current output 1004, and an AC current output 1006.

The controller 226 performs a testing sequence for the LED strings 116-L by generating and transmitting display instructions for a fast animated succession that turns on and then turns off, sequentially, every singular LED (e.g. pixel 118 or LED of a pixel 118) of the LED string 116-L. The current monitor 232-2 measures the total current through the LED string 116-L via the lamp power input 1000 and the lamp power output 1002 and outputs a signal representing the measured current to the controller 226 via the DC current output 1004 or the AC current output 1006.

The controller 226 determines the diagnostic status of the LED strings 116-L based on the measured current. For example, if one pixel 118 or LED of a pixel 118 is broken or interrupted, the process of turning the LED on and then off does not create any output, and the controller 226 detects that the LED is non-functional. By determining the number of impulses indicating the measured current and processing the number of impulses against a known number of LEDs (e.g. three LEDs per pixel 118), the controller 226 identifies if any individual color LED inside the pixels 118 are damaged. The controller 226 also evaluates the position of the broken LED (e.g. based on where in the testing sequence the lack of pulse was detected) and estimates which pixel 118 of the LED string 116-L is broken.

In one example, the controller 226 determines whether the number of failed LEDs and/or pixels 118 is above a predetermined failure threshold, in which case the controller 226 generates the display instructions including the diagnostic data indicating the fault in the LED strings 116-L (e.g. by modulating which iterations of the display instructions include the diagnostic data or by not including any diagnostic data in the display instructions).

The current monitor 232-2 functions dynamically during normal operation. For example, during a period of time in which the LED strings 116-L display an animation (e.g. including a red bar rotating around the signaling device 102 from one indicating surface 114 to the other), the overall current consumed by the LED strings 116-L remains steady when there are no burned or non-functional pixels 118, because each of the LED strings 116-L illuminates the same number of pixels 118 of the same colors at the same intensity, but at different times. However, when there exist one or more burned pixels 118, the overall current consumed by the LED strings 116-L will dip when the LED string 116-L with the burned pixel 118 displays a frame of the animation. Thus, the current monitor 232-2 includes a capacitor 1012 for isolating variations in the current and a gain block 1008 for amplifying the variations, for example, as an AC signal which is output to the controller 226 via the AC current output 1006. The controller 226 determines the diagnostic status of the LED strings 116-L based on the AC signal representing the variation in the current consumed by the LED strings 116-L, for example, by correlating the variations in the current with the expected current consumption (e.g. including whether the current is expected to vary or not) for the different frames of the animation.

Alternatively, the dynamic diagnosis functionality performed by the current monitor 232-2 in conjunction with the controller 226 can be performed using the DC output 1004 and a high resolution fast ADC and a big amount computation power.

Figure 11A:
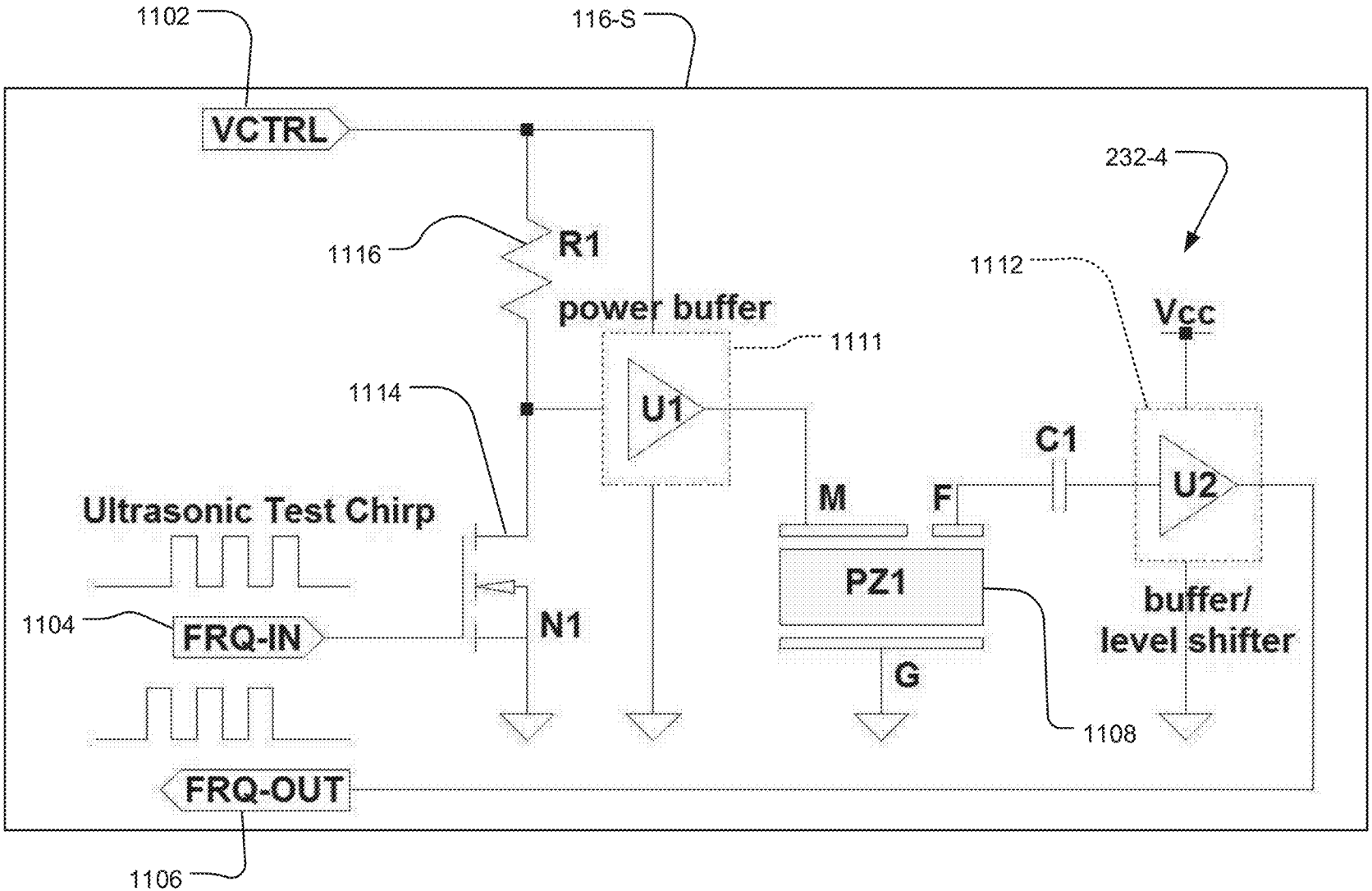
FIG. 11A is a circuit diagram of a sound indicator of the signaling device according to one embodiment.

FIG. 11A is a circuit diagram of the sound indicator 116-S according to one embodiment.

As previously described, the sound indicator 116-S presents the status information 246-S for the monitored system 208 by emitting sound. In the illustrated embodiment, the sound indicator 116-S is a siren.

The sound indicator 116-S includes a control input 1102, a frequency input 1104, a frequency output 1106, a piezo element 1108, a power buffer 1111, a metal-oxide-semiconductor field-effect transistor (MOSFET) 1114, and a resistor 1116.

The sound indicator 116-S uses the 3-lead piezo element 1108 as a mechanical sounder to emit the sound based on a 50% duty cycle variable frequency pulse width modulation (PWM) signal from the controller 226, which the sound indicator 116-S receives via the frequency input 1104. The power buffer 1111 (e.g. including multiple buffers in parallel) increases the applied voltage received via the control input 1102, increasing the power of the sound emitted via the piezo element 1108. Specifically, the power buffer 1111, along with the MOSFET 1114 and the resistor 1116, form a level shifter, and the power buffer 1110 drives the piezo element 1108 at the voltage received via the control input 1102. The controller 226 varies the voltage of the control input 1102 in order to modulate the sound power level.

In normal operation mode (e.g. when the siren is activated), on the frequency input 1104 is applied a 50% PWM signal with a variable, audible frequency (e.g. in the range of 20-20,000 Hertz (Hz)), for example, from a frequency sequence table containing values defining desired sound profiles for the emitted sound. The table is indexed in-loop to achieve the desired sound pattern.

The sound indicator 116-S includes embedded diagnostic monitor elements 232-4, including a buffer 1112 and a capacitor connected to the F terminal of the piezo element 1108, which normally is used for a self-resonant piezo operation. Via the F terminal of the piezo element 1108, the diagnostic monitor elements 232-4 generate a diagnostic output electrical signal based on any detected mechanical membrane displacement. For example, the movement of the piezo element 1108 generates a signal that is detected via the feedback pin F and output via the frequency output 1106 to the controller 226 to be analyzed.

In one example, the diagnostic monitor elements 232-4 generate a digital diagnostic output electrical signal. In this case, the buffer 1112 is a window comparator which outputs a digital signal to the controller 226.

In another example, the diagnostic monitor elements 232-4 generate an analog diagnostic output signal based on the mechanical membrane displacement of the piezo element 1108 (in which case the capacitor Cl shown in the illustrated example is not included). Here, the buffer 1112 is a level shifter, which shifts the voltage of the diagnostic output electrical signal to one expected by the analog-to-digital converter (ADC) input of the controller 226. The controller 226 then processes the incoming signal in order to determine additional information about the siren mechanics.

During testing of the sound indicator 116-S, the controller 226 applies an ultrasonic (e.g. in a non-audible frequency range such as frequencies above 20,000 Hz) short pulse train of a fixed frequency as the test pattern via the frequency input 1104, which is then emitted by the piezo element 1108 as a series of ultrasonic test chirps. The controller 226 determines the diagnostic status of the sound indicator 116-S based on the digital and/or analog diagnostic output electrical signal generated based on the ultra-sonic pulse train detected and returned to the controller 226. For example, if the same testing signal input by the controller 226 to the sound indicator 116-S via the frequency input 1104 is replicated at the frequency output 1106, the controller 226 determines that the siren circuitry is electrically and mechanically functional.

Because the ultrasonic test chirps are non-audible, the testing procedure can be repeated continuously.

Figure 11B:
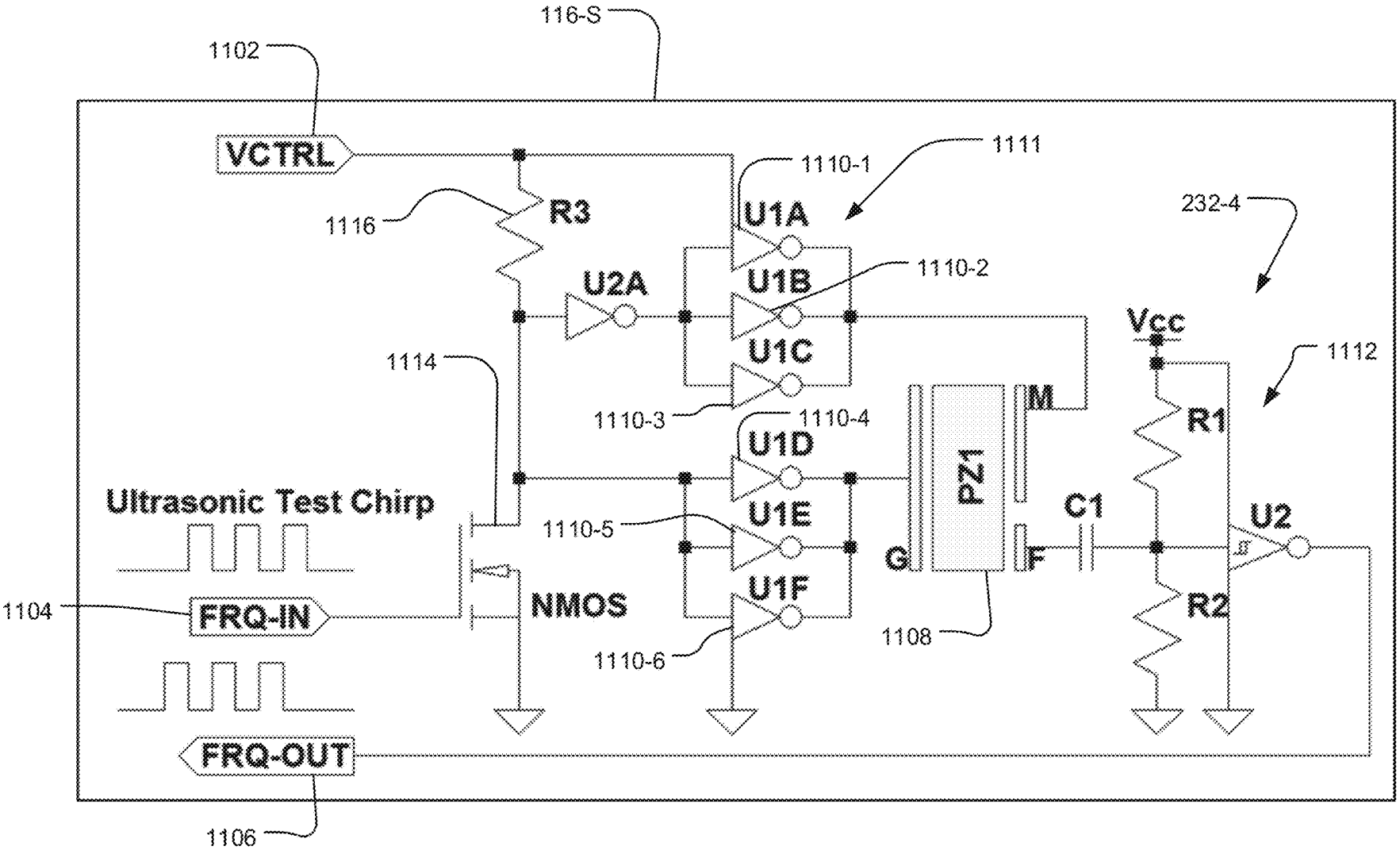
FIG. 11B is a circuit diagram of the sound indicator according to another embodiment.

FIG. 11B is a circuit diagram of the sound indicator 116-S according to another embodiment.

The sound indicator 116-S is similar to the one described with respect to FIG. 11A.

Now, however, the power buffer 1111 specifically includes six buffers 1110-1 through 1110-6, which double the applied voltage, further increasing the power of the sound emitted by the piezo element 1108. By putting the buffers 1110 in parallel, the buffer capability to drive the piezo element 1108 is increased. For example, with a lower power piezo element 1108, one or two integrated circuits with six buffers 1110 in parallel can be used to achieve the required power.

Additionally, the buffer 1112 of the diagnostic monitor elements 232-4 specifically includes a Schmitt trigger buffer 1112. Here, the electrical signal from the F terminal of the piezo element 11108 is applied to the Schmitt trigger buffer 1112 to be converted to digital logic, which is then output to the controller 226 via the frequency output 1106.

Figure 12:
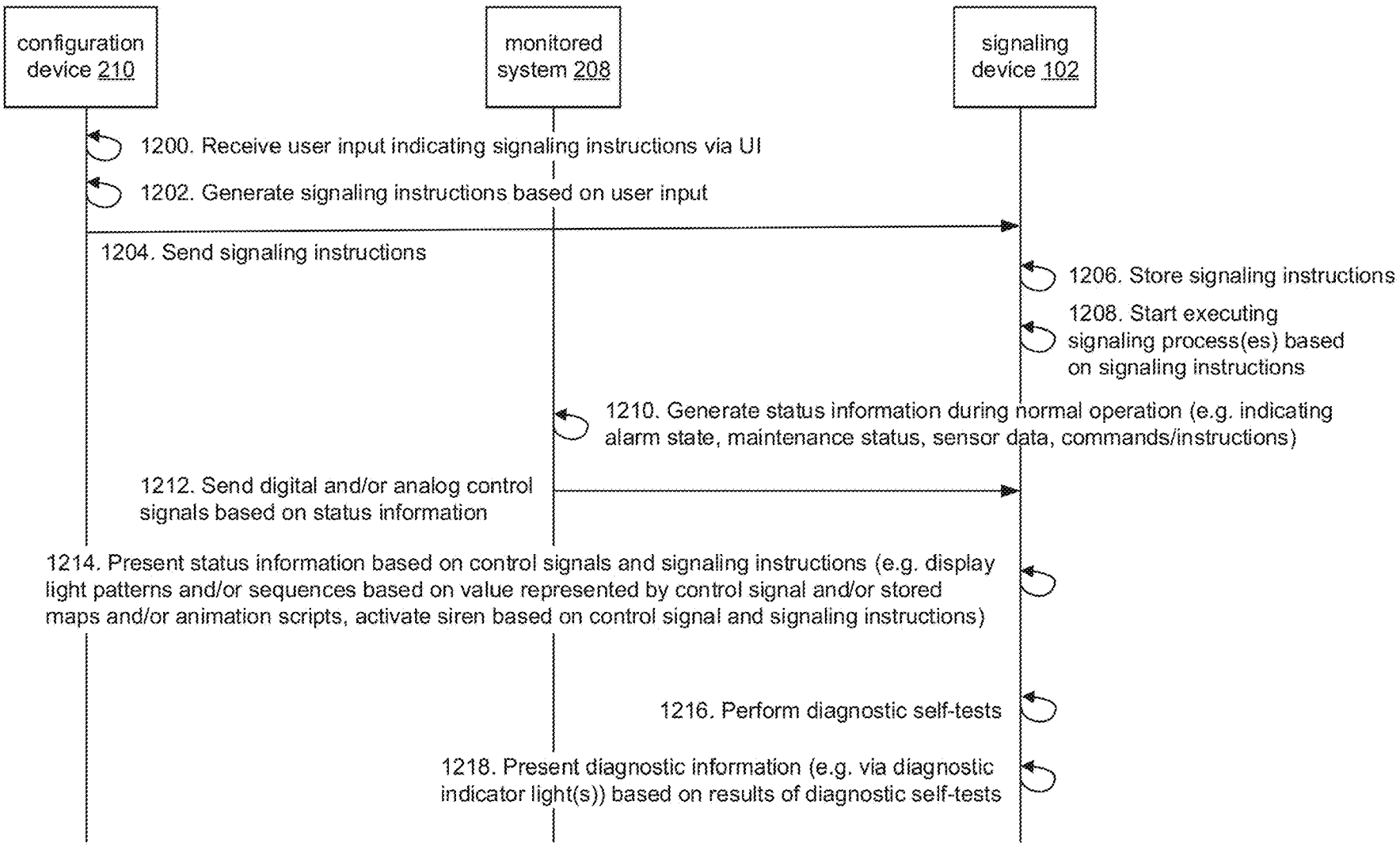
FIG. 12 is a sequence diagram illustrating functionality of the signaling system.

FIG. 12 is a sequence diagram illustrating functionality of the universal programmable optic/acoustic signaling system 100 at a high level.

First, in step 1200, the configuration device 210 receives the user input 242 indicating the desired configuration settings and/or functionality of the signaling device 102 from a user or technician configuring the signaling device 102 via the UI 220. In step 1202, the configuration device 210 generates the signaling instructions 240 based on the received user input 242 and sends the signaling instructions 240 to the signaling device 102 in step 1204.

In step 1206, the signaling device 102 stores the signaling instructions 240 (e.g. in the non-volatile memory 228) and in step 1208 starts executing one or more signaling processes 236 based on the signaling instructions 240.

In step 1210, the monitored system 208 generates the internal status information 238 during normal operation of the monitored system 208 (e.g. via the monitored elements 212), and, in step 1212, the monitored system 208 sends digital and/or analog control signals 244 to the signaling device 102 based on the internal status information 238.

In step 1214, the signaling device 102 presents the status information 246 to observers within or pertinent to the monitored system 208, for example, by emitting light and sound patterns/sequences based on values represented by the control signals 244, and stored signaling instructions 240, including pixel maps, animation scripts, and/or the frequency table for the sound indicator 116-S.

In step 1216, on a continuous basis before, during and/or after the signaling steps in steps 1210 through 1214, the signaling device 102 also performs diagnostic self-tests via the diagnostic monitors 232 to determine the current diagnostic status of the device. In step 1218, the signaling device 102 presents the diagnostic information 248 based on the results of the diagnostic self-tests (e.g. via LEDs of the diagnostic indicator 234 emitting light).

Figure 13:
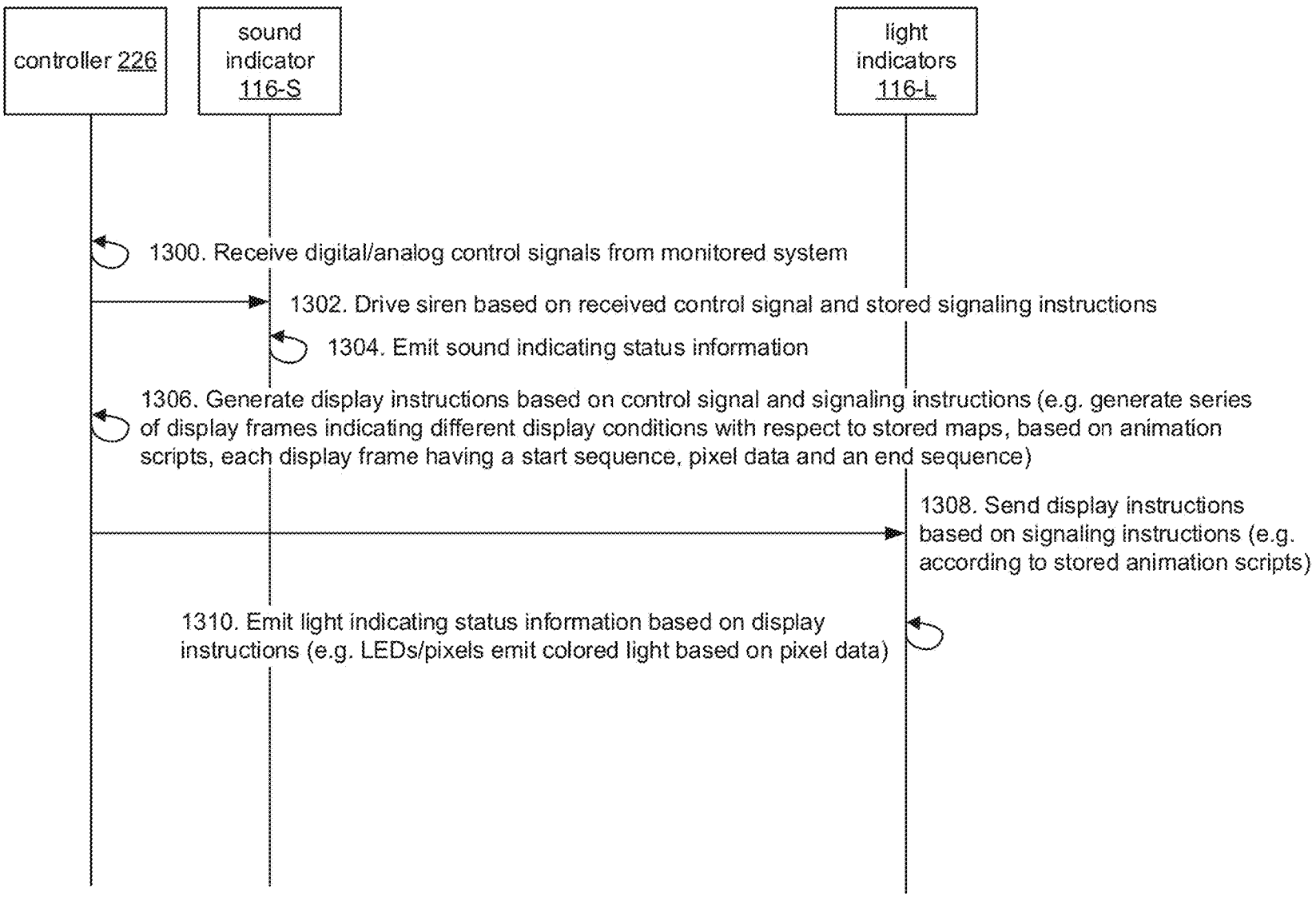
FIG. 13 is a sequence diagram illustrating a process by which the signaling device presents the status information for the monitored system.

FIG. 13 is a sequence diagram illustrating in more detail a process by which the signaling device 102 presents the status information 246 for the monitored system 208 based on the control signals 244.

In general, this process corresponds to steps 1212 and 1214 that were previously described with respect to FIG. 12. Now, however, more detail is provided.

Figure 17:
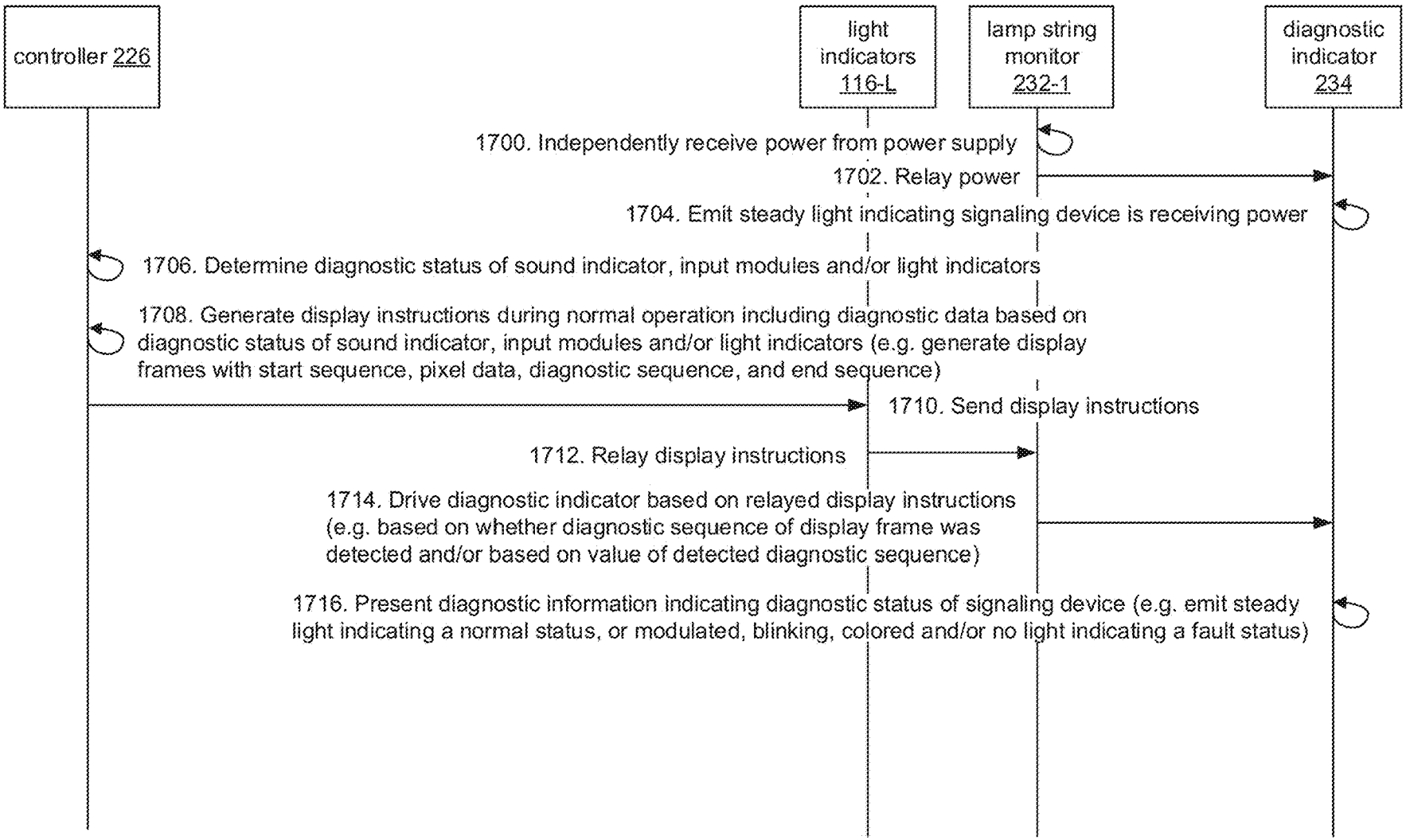
FIG. 17 is a sequence diagram illustrating a process by which the signaling device presents diagnostic information.
Figure 19:
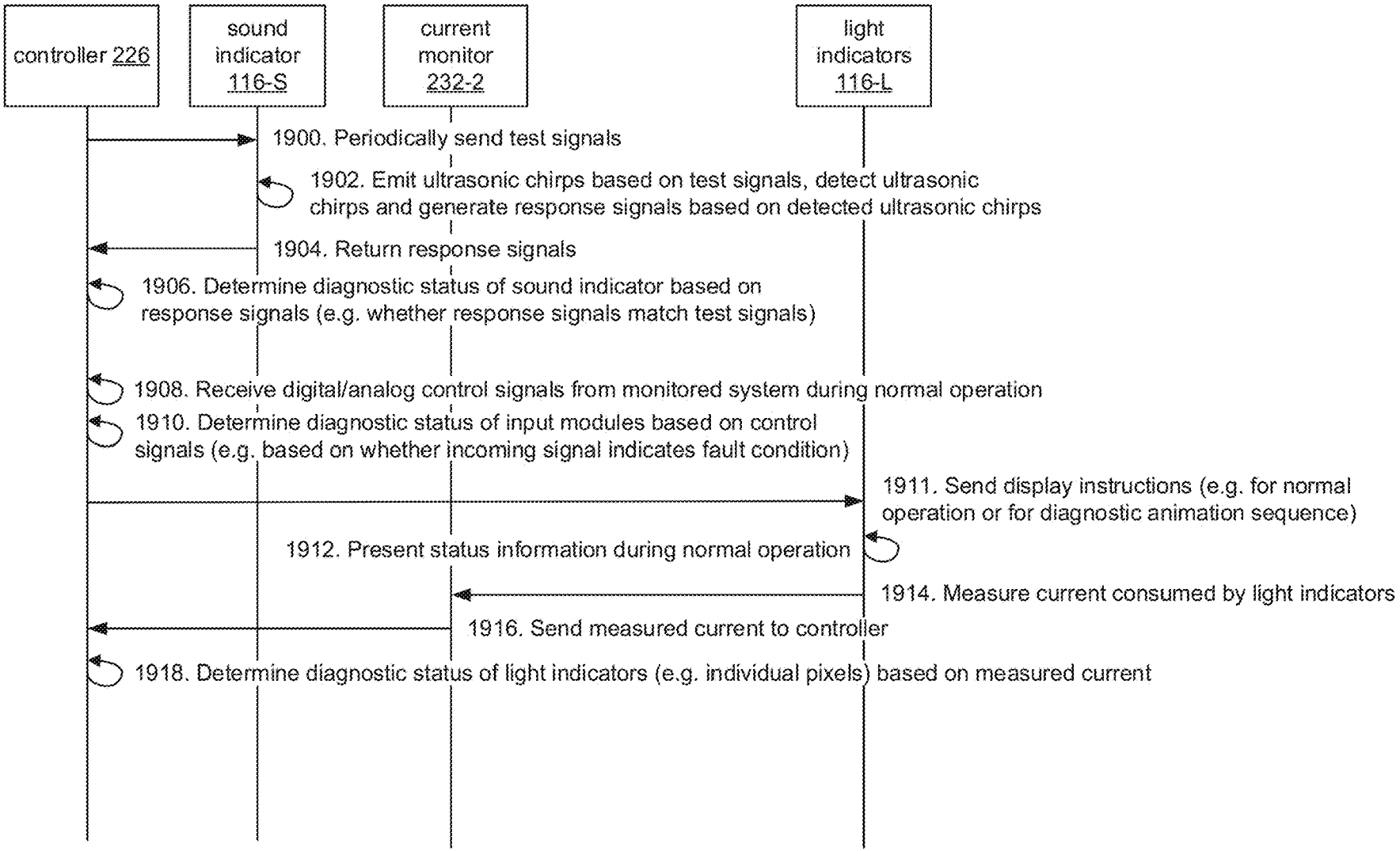
FIG. 19 is a sequence diagram illustrating a process by which the signaling device determines a diagnostic status of the sound indicator, input modules, and light indicators.

It should be noted that the process of determining the diagnostic status of the signaling device 102 and presenting the diagnostic information 248 (e.g. steps 1216 and 1218 previously described with respect to FIG. 12 and the additional details to be provided with respect to FIGS. 17 and 19) can occur before, during and/or after the following process of presenting the status information 246, and some steps of both processes may overlap (e.g. sending the display instructions including both the pixel data and the trailing diagnostic frames). However, for the purpose of clarity, only the process of presenting the status information is shown in the illustrated example.

First, in a default or off state, the controller 226 continuously generates and sends refreshed iterations of display instructions to the light indicators 116-L (e.g. including pixel data indicating that the pixels 118 should all be off). These default display instructions include diagnostic data such as the trailing diagnostic frame, which is used by the lamp string monitor 232-1 to continuously drive the diagnostic indicator 234 to present the diagnostic information 248, even when no light or sound is being emitted by the light indicators 116-L and the sound indicators 116-S.

In step 1300, the controller 226 of the signaling device 102 receives the digital/analog control signals 244 from the monitored system 208 via the input modules 222. In one example (not illustrated), the controller 226 also receives fault signals from the input modules 222 based on the self-diagnostic process performed by the input modules 222.

In step 302, the controller 226 drives the sound indicator 116-S (e.g. siren) to present the status information 246-S for the monitored system 208 by emitting sound based on the received control signals 244 and on the stored signaling instructions 240 such as the frequency table.

In step 1304, the sound indicator 116-S presents the status information 246-S by emitting sound according to signals received by the controller 226.

In step 1306, the controller 226 generates the display instructions based on the control signals 244 and the stored signaling instructions 240. For example, the controller 226 generates individual iterations of display instructions such as display frames indicating different display conditions of the LED strings 116-L with respect to the pixel maps, including a start sequence, pixel data, and an end sequence. In one example, the display instructions generated by the controller 226 in step 1306 also include diagnostic data such as the trailing diagnostic frame.

In step 1308, the controller 226 sends the display instructions to the light indicators 116-L, for example, by sending the display frame including the pixel data to the first LED string 116-L-1. In step 1310, the light indicators 116-L emit light based on the display instructions. For example, each of the pixels 118 in the LED strings 116-L emit light with a different color based on the pixel data associated with the pixel 118 in the received display instructions. In one example, the light indicators 116-L relay the display instructions (e.g. the trailing diagnostic frame) to the lamp string monitor 232-1 based on diagnostic data included with the display instructions, and the lamp string monitor 232-1 drives the diagnostic indicator 234 to present the diagnostic information 248 based on the diagnostic data. Similarly, in another example, while the light indicators 116-L emit the light indicating the status information 246-L, the current monitor 232-2 measures the current consumed by the light indicators 116-L and outputs the measured current to the controller 226, which generates diagnostic data based on the current and includes the diagnostic data in subsequent iterations of the display instructions.

The controller 226 continuously repeats the process of steps 1306 through 1310, generating updated or refreshed display frames based on a predetermined refresh rate. The display frames may differ between refreshed iterations of the display instructions based on a stored animation script, resulting in an animation being displayed across the LED strings 116-L.

Figure 14:
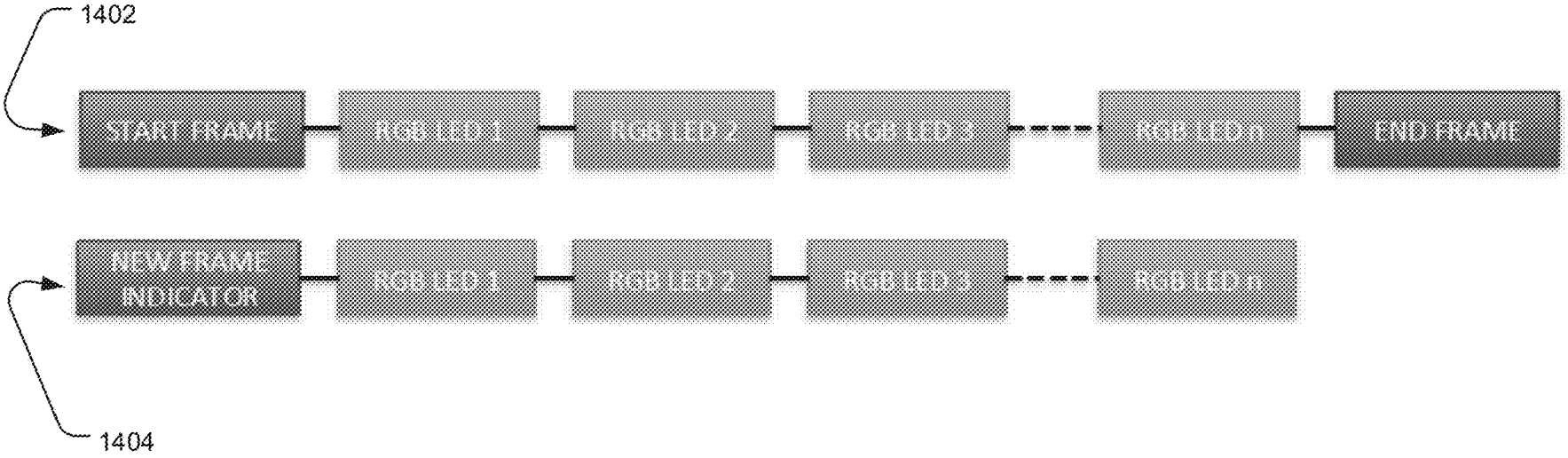
FIG. 14 is a diagram of exemplary display frames indicating display instructions for the light indicators.

FIG. 14 is a diagram of exemplary display frames indicating the display instructions used by the LED strings 116-L to present the status information 246-L.

As previously mentioned, the display frame is an example of an individual iteration of the display instructions generated by the controller 226, with each display frame indicating a momentary display state or static image for each of the pixels 118 of the LED strings 116-L.

In general, these display frames are continuously refreshed, with new pixel data indicating a different (or possibly the same) display state for the pixels 118. One or more predetermined refresh rates determine the number of display frames per second that are generated by the controller 226 and transmitted to the LED strings 116-L.

In the illustrated example, an exemplary display frame 1402 (e.g. for use with synchronous LEDs) includes a start sequence indicating the start of the display frame and that new pixel data is available to refresh the old pixel data, the pixel data itself indicating the display state such as illumination status and/or color of each pixel 118, and an end sequence indicating the end of the display frame, which is required to update all of the LEDs because the clock signal is delayed for each LED, for example, at an interval having a period of halfway through the chain of LEDs. A second exemplary display frame 1404 (e.g. for use with asynchronous LEDs), includes a reset sequence or new frame indicator, which indicates that refreshed pixel data is available to be loaded. In this example, a specific pattern for 0 and 1 bits requires accurate timing.

Figure 15:
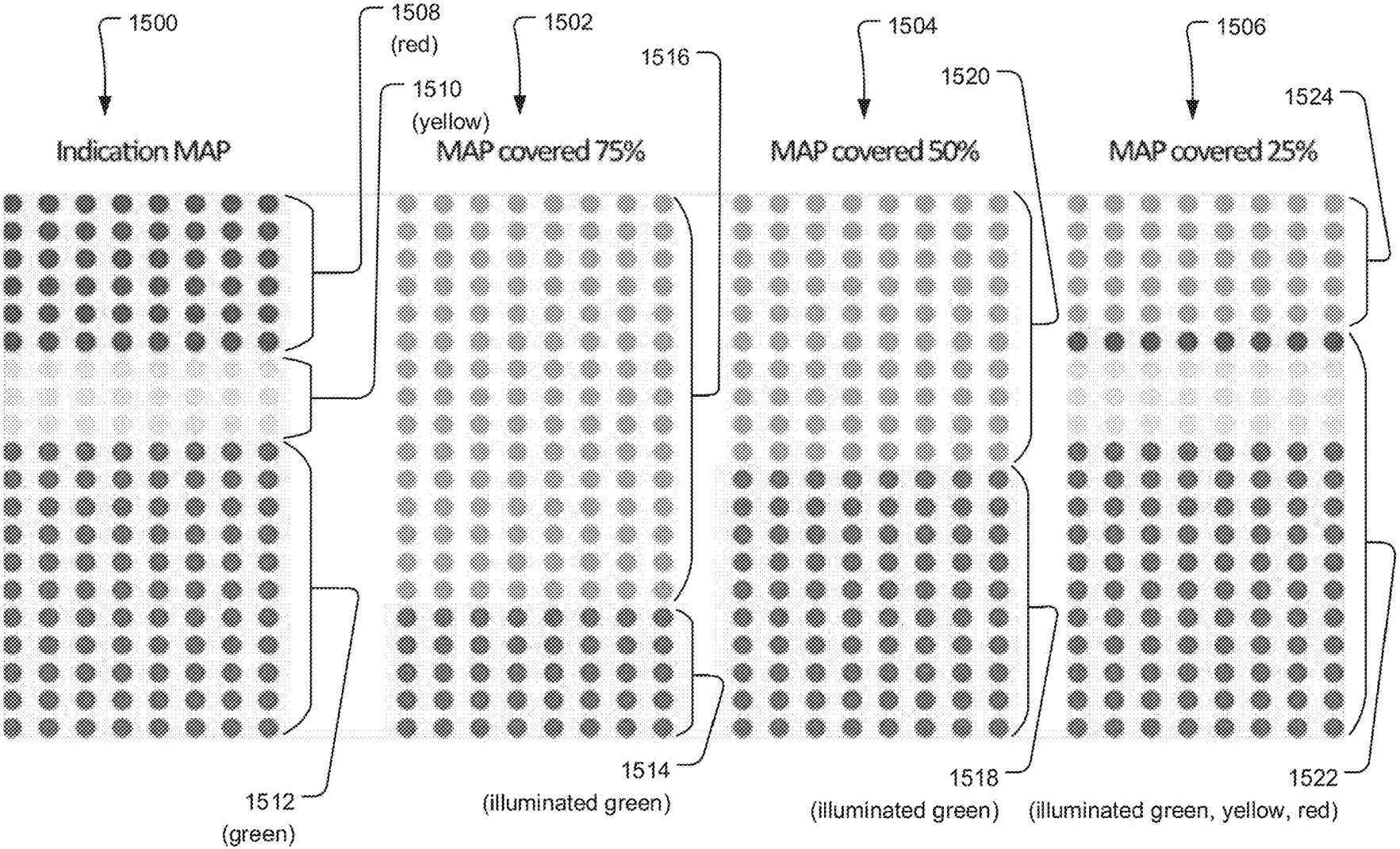
FIG. 15 is a graphical representation of exemplary unfolded pixel maps for incoming analog control signals received by the signaling device.

FIG. 15 is a graphical representation of exemplary unfolded pixel maps for incoming analog control signals 244 showing different possible display states for the pixels 118 of the LED strings 116-L based on the different incoming analog control signals 244. In one example, these pixel maps are generated by the configuration device 210 as part of the signaling instructions 240, transferred to and stored in non-volatile memory 228 of the signaling device 102, and accessed by the signaling processes 236 executing on the controller 226 of the signaling device 102.

In general, the pixel maps are collections of pixel data (e.g. indicating colors such as red, green, or blue for each pixel 118) representing the collective image displayed on the LED strings 116-L. In one example, the pixel map is larger than the actual array of pixels 118 (e.g. containing data for more pixels 118 than exist on the LED strings 116-L), in which case the full extent of the pixel map is be revealed through animation, as different regions of the full pixel map are displayed.

By default, an "off" pixel map is used. The "off" map is a static map displayed in when no input is received via the input modules 222 (e.g. the digital input modules 222 are in a low state, the analog input modules 222 receive input below a minimum input threshold).

In one example, in a digital input mode of the signaling device 102, every combination of possible digital inputs (e.g. fifteen different binary combinations for four digital input modules 222, plus one "off" combination in which all inputs are low) is associated with a different animation script. Based on the associated animation script, the controller 226 repeatedly generates a predetermined sequence of display frames for the animation until the current input state is changed and a new input state is detected based on a different combination of inputs from the digital input modules 222.

In the illustrated example, the different display states indicated by the pixel maps represent different analog values indicated by the incoming analog control signals 244. In one example, one or more of the input modules 222 are configured as analog inputs, receiving analog values indicating a liquid capacity of a tank based on sensor data generated by the monitored system 208.

In general, the pixel maps 1500, 1502, 1504, 1506 include graphical representations of pixels arranged in an 8×20 array, with the eight vertical columns representing the eight LED strings 116-L (each of which would be mounted to a different indicating surface 114 of the assembly 104) and the twenty horizontal rows indicating the corresponding pixels 118 within each LED string 116-L. It should be noted that, although the pixel maps are represented in the illustrated example via a graphical depiction, in embodiments, the pixel maps can be stored as data formatted in a variety of ways.

Specifically, four pixel maps are represented, a reference map 1500, a 25% capacity pixel map 1502, a 50% capacity pixel map 1504, and a 75% capacity pixel map 1506.

The reference map 1500 indicates a display state for the pixels 118 of the LED strings 116-L based on analog control signals 244 indicating that the tank is full. Three colored regions 1508, 1510, 1512 span different portions of the pixel map, spanning across all eight vertical columns and spanning across different sets of horizontal rows. Specifically, the green region 1512 covers the bottom eleven horizontal rows, the yellow region 1510 covers the next three horizontal rows, while the red region 1508 covers the top six horizontal rows. Each of these colored regions are an interpretation of the incoming analog control signals 244. For example, the green region 1512 on the bottom represents a safe level, the yellow region 1510 in the middle represents a warning message, and the red region 1508 on top represents a dangerous level. As the capacity of the tank changes, the incoming control signals 244 represent different numerical values, resulting in different proportions of the reference map 1500 being illuminated progressively, with the illuminated pixels of the upper rows turning from green to red.

The other pixel maps 1502, 1504, 1506 show the display states as the capacity changes. These maps are versions of the reference pixel map 1500 with the same arrangement of colors at corresponding regions of the maps but with different proportions covered and illuminated.

The 25% capacity pixel map 1502 is a graphical representation of the pixel map for the display state when the tank is 25% full (e.g. according to the incoming analog control signals 244). An illuminated green region 1514 on the bottom covers approximately 25% of the map, while a covered region 1516 covers the top 75% of the map, representing the unused capacity of the tank, for example. According to this map, the display state for each of the LED strings 116-L is that the bottom six pixels 118 are illuminated green, while the rest of the pixels 118, which are in the covered region 1516, are turned off or are illuminated with a uniform low intensity illumination (allowing observers to see the entire lamp body even in a dark environment, for example).

The 50% capacity pixel map 1504 is a graphical representation of the pixel map for the display state when the tank is 50% full (e.g. according to the incoming analog control signals 244). An illuminated green region 1518 on the bottom covers approximately 50% of the map, while a covered region 1520 covers the top 50% of the map, representing the unused capacity of the tank, for example. According to this map, the display state for each of the LED strings 116-L is that the bottom ten pixels 118 are illuminated green, while the rest of the pixels 118, which are in the covered region 1520, are turned off or are illuminated with a uniform low intensity illumination.

The 75% capacity pixel map 1506 is a graphical representation of the pixel map for the display state when the tank is 75% full (e.g. according to the incoming analog control signals 244). An illuminated region 1522 on the bottom covers approximately 75% of the map (with green, yellow and red regions matching the corresponding regions of the reference map 1500), while a covered region 1524 covers the top 25% of the map, representing the unused capacity of the tank, for example. According to this map, the display state for each of the LED strings 116-L is that the bottom eleven pixels 118 are illuminated green, the next three pixels 118 from the bottom are illuminated yellow, the next one pixel 118 from the bottom is illuminated red, while the rest of the pixels 118, which are in the covered region 1524, are turned off or are illuminated with a uniform low intensity illumination.

In one embodiment, the extent of the covered region for a given pixel map is based on the following calculation (based on the input values represented by the analog control signals 244):

$$\text{MAP Coverage (\%)}=\text{Interpolate}[k1*(\text{Input_1}-\text{Offset_1})+k2*(\text{Input_2}-\text{Offset_2})]$$

Processing the analog inputs is initialized by defining the reference map (e.g. image displayed across the LED strings 116-L for maximum input), a predetermined danger script to be executed when the calculated MAP Coverage exceeds 100% (e.g. flashing red lights and turning on the siren), a linear interpolation table (data should be interpolated for a non-linear input) and values for k1, k2, Offset_1, and Offset_2 as input calculation coefficients. For example, if the signaling device 102 is used to indicate a tank fluid level based on an analog input Input_1 received via one of the input modules 222, the coefficient k2 is set to 0. On the other hand, to indicate a differential pressure between two tanks based on analog input values Input_1 and Input_2 received via two different input modules 222, k1 is set to 1, and k2 is set to −1.

In another example (not illustrated), the pixel map for the display state when the analog control signals 244 indicate that the capacity is at a minimum level includes a covered region spanning the entire reference map. On the other hand, the pixel map for the display state when the analog control signals 244 indicate that the capacity is at a maximum level is simply the reference map itself, with no covered region.

Figure 16:
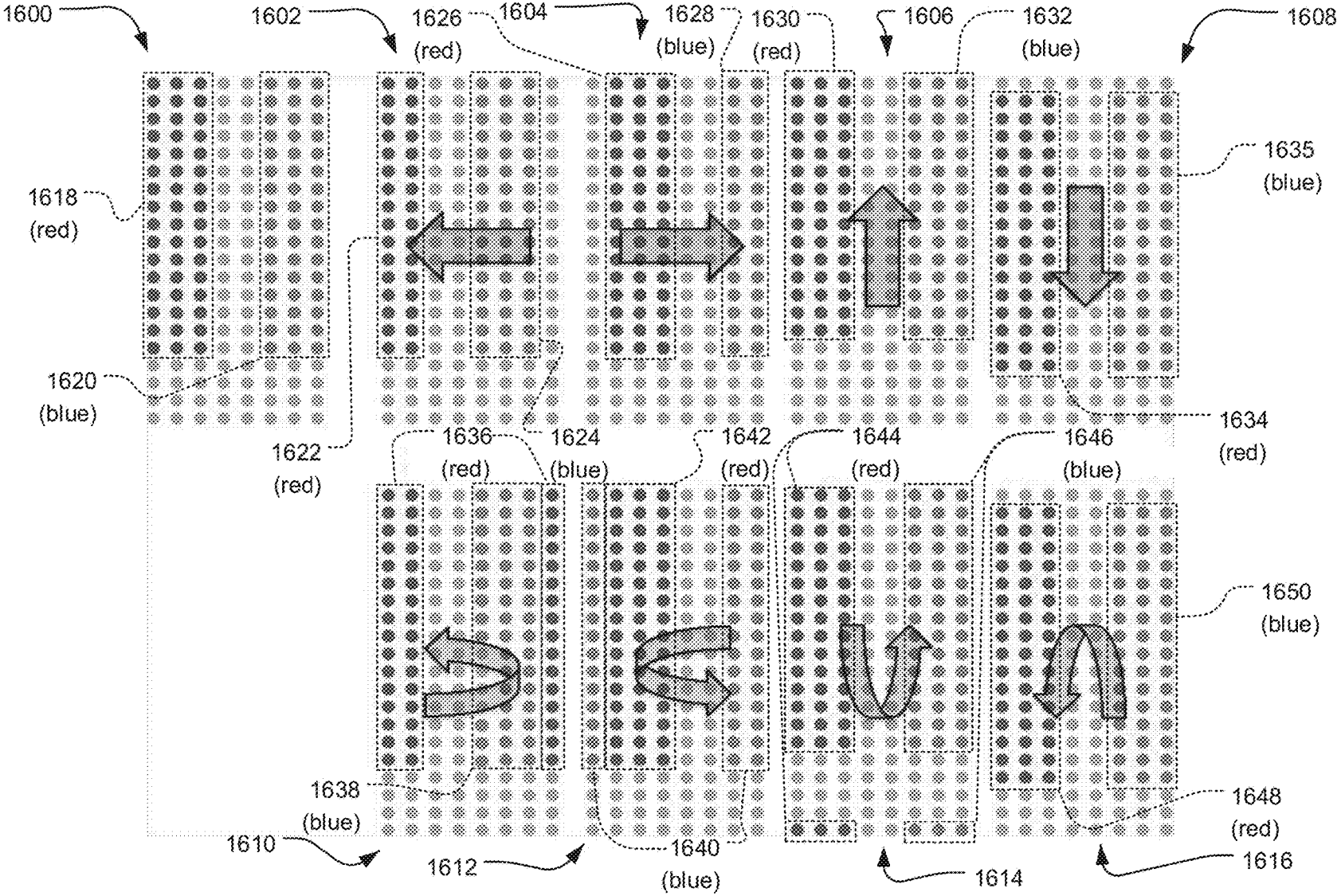
FIG. 16 is a graphical representation of exemplary unfolded pixel maps showing different possible animations displayed by the signaling device.

FIG. 16 is a graphical representation of exemplary unfolded pixel maps showing different possible animations based on the animation scripts. As before, in one example, these pixel maps are generated by the configuration device 210 as part of the signaling instructions 240, transferred to and stored in non-volatile memory 228 of the signaling device 102, and accessed by the signaling processes 236 executing on the controller 226 of the signaling device 102.

In general, the animations are sequences of display frames representing display states of the LED chains 116-L, for example, forming visual signaling patterns including movement, changing colors, blinking lights (of single or multiple colors), pulsing (e.g. increasing or decreasing light intensity), among other examples. The animations are displayed based on animation scripts processed by the controller 226 in generating the display frames.

In one embodiment, the animation script is a sequence of instructions for generating the display frames executed in a loop at a specific timing or refresh rate, for example, based on different control signals 244 received via the input modules 222. These instructions include load map, load siren_profile, scroll, roll, delay, pulse, blink, fade, siren start, siren stop, and/or repeat, among other examples.

The animation scripts are generally executed repeatedly in a loop (e.g. after the last instruction, the sequence is restarted) as long as there is no infinite repeat at the end of sequence (e.g. the animation script indicates that the signaling device 102 blinks red and activates the siren indefinitely at the end of an animation). The animation sequence is executed as long as the decoded input (ranging from 0 to 15, based on the different permutations of binary inputs from the input modules 222) matches with an index for the current running script.

In the illustrated example, the pixel maps are similar to those described with respect to FIG. 15.

Now, however, nine pixel maps are represented, a reference map 1600, a shift left map 1602, a shift right map 1604, a shift up map 1606, a shift down map 1608, a roll left map 1610, a roll right map 1612, a roll up map 1614, and a roll down map 1616.

The reference map 1600 indicates a display state for the pixels 118 of the LED strings 116-L at the beginning of the animation. Two colored regions 1618, 1620 span different portions of the pixel map. Specifically, the red region 1618 spans a region at the top left corner of the map that is sixteen horizontal rows from top to bottom and three vertical columns from left to right. The blue region 1620 covers a similarly sized region at the top right of the map. The red region 1618 represents pixels 118 of the LED strings 116-L that emit red light, and the blue region 1620 represents pixels 118 of the LED strings 116-L that emit blue light. The rest of the pixel map, including all other pixels (shaded gray), are turned off.

All of the other maps 1602, 1604, 1606, 1608, 1610, 1612, 1614, 1616 pertain to different animations, which are indicated with respect to the reference map 1600. More specifically, the reference map 1600 represents the display state for the first display frame in the animation sequence, while the subsequent maps represent subsequent display states in the associated animation.

Specifically, the shift left map 1602 shows the subsequent display state when the two colored regions shift to the left. A shifted red region 1622 and blue region 1624 have each moved one vertical column to the left with respect to the reference map 1600, with a smaller red region 1622 (compared to the red region 1618 of the reference map 1600) showing how the red region 1622 is displayed as having moved off of the visible screen (e.g. formed by the LED strings 116-S).

The shift right map 1604 shows the subsequent display state when the two colored regions shift to the right. A shifted red region 1626 and blue region 1628 have each moved one vertical column to the right with respect to the reference map 1600, with a smaller blue region 1628 (compared to the blue region 1620 of the reference map 1600) showing how the blue region 1628 is displayed as having moved off of the visible screen.

The shift up map 1606 shows the subsequent display state when the two colored regions shift up. A shifted red region 1630 and blue region 1632 have each moved one horizontal row up with respect to the reference map 1600, with a smaller red region 1630 and blue region 1632 (compared to the red region 1618 and blue region 1620 of the reference map 1600) showing how the red region 1630 and blue region 1632 are displayed as having moved off of the visible screen.

The shift down map 1608 shows the subsequent display state when the two colored regions shift down. A shifted red region 1634 and blue region 1635 have each moved one horizontal row down with respect to the reference map 1600.

The roll left map 1610 shows the subsequent display state when the two colored regions roll to the left. A rolled red region 1636 and blue region 1638 have each moved one vertical column to the left with respect to the reference map 1600, with the red region 1636 split between two vertical columns on the left of the map and one vertical column on the right of the map, showing how the red region 1636 is displayed as having rolled around to the opposite side of the screen.

The roll right map 1612 shows the subsequent display state when the two colored regions roll to the right. A rolled red region 1642 and blue region 1640 have each moved one vertical column to the right with respect to the reference map 1600, with the blue region 1640 split between two vertical columns on the right of the map and one vertical column on the left of the map, showing how the blue region 1640 is displayed as having rolled around to the opposite side of the screen.

The roll up map 1614 shows the subsequent display state when the two colored regions roll up. A rolled red region 1644 and blue region 1646 have each moved one vertical column up with respect to the reference map 1600, with both the red region 1644 and blue region 1646 split between fifteen horizontal rows on the top of the map and one horizontal row on the bottom of the map, showing how both regions are displayed as having rolled around to the opposite side of the screen.

Finally, the roll down map 1616 shows the subsequent display state when the two colored regions roll down. A rolled red region 1648 and blue region 1650 have each moved one vertical column down with respect to the reference map 1600.

In general, the roll maps 1610, 1612, 1614 and 1616 designate as the next column to the left of the leftmost column the column all the way to the right, designate as the next column to the right of the rightmost column the column all the way to the left, designate as the next row above the topmost row the bottommost row, and designate as the next row below the bottommost row the topmost row. This looping effect allows continuous movement, visible from 360 degrees around the signaling device 102. In one example, in order to signal danger to observers in all directions, a red bar displayed in one or more columns can be rotated around through all viewing directions of the signaling device 102, providing motion to draw the eye while at the same time alerting observers in all viewing directions.

FIG. 17 is a sequence diagram illustrating in more detail the process by which the signaling device 102 presents the diagnostic information 248.

First, in step 1700, the lamp string monitor 232-1 independently receives power from the power supply 230. The lamp string monitor 232-1 relays the power to the diagnostic indicator 234 in step 1702, and, in step 1704, the diagnostic indicator 234 emits steady light indicating the signaling device 102 is receiving power.

In step 1706, the controller 226 determines the diagnostic status of the sound indicator 116-S, the input modules 222, and/or the light indicators 116-L. In one example, the controller 226 determines the diagnostic status of the sound indicator 116-S via the embedded diagnostic monitor 232-4 elements of the sound indicator 116-S, the controller 226 determines the diagnostic status of the input modules 222 via the embedded diagnostic monitor 232-3 elements of the input modules 222, and the controller 226 determines the diagnostic status of the light indicators 116-L via the current monitor 232-2.

In step 1708, the controller 226 generates display instructions during normal operation of the signaling device 102, the display instructions including diagnostic data based on the diagnostic status of the sound indicator 116-S, input modules 222, and/or the light indicators 116-L. In one example, the controller 226 generates display frames including pixel data and a trailing diagnostic sequence to indicate a normal diagnostic status. In another example, the controller 226 generates display frames that include pixel data and intermittently include a trailing diagnostic sequence to indicate a fault status. The frequency at which the controller 226 intermittently includes the trailing diagnostic sequence is based on particular faults, such as a siren fault or an input fault. In yet another example, the controller 226 generates display frames that do not include the trailing diagnostic sequence to indicate a pixel fault status. In yet another example, the controller 226 generates display frames with trailing diagnostic data, the value of which indicates the diagnostic status.

In step 1710, the controller 226 sends the generated display instructions to the light indicators 116-L, and, in step 1712, the light indicators 116-L relay the display instructions to the lamp string monitor 232-1.

In step 1714, the lamp string monitor 232-1 drives the diagnostic indicator 234 based on the relayed display instructions. In one example, the lamp string monitor 232-1 drives the diagnostic indicator to emit steady light to indicate a normal diagnostic status in response to consistently receiving the trailing diagnostic data in successive iterations of the display instructions. In another example, the lamp string monitor 232-1 drives the diagnostic indicator 234 to modulate the emitted light based on intermittently receiving the trailing diagnostic data in successive iterations of the display instructions. In yet another example, the lamp string monitor 232-1 drives the diagnostic indicator 234 to emit no light in response to receiving no trailing diagnostic data for a predetermined period of time. In yet another example, the lamp string monitor 232-1 drives the diagnostic indicator 234 to emit the light based on the value of the diagnostic data received from the controller 226.

Finally, in step 1716, the diagnostic indicator 234 presents the diagnostic information 248-L indicating the diagnostic status of the signaling device 102 (e.g. by emitting steady light to indicate a normal status, modulated, blinking, colored, or no light to indicate a fault status).

Figure 18:
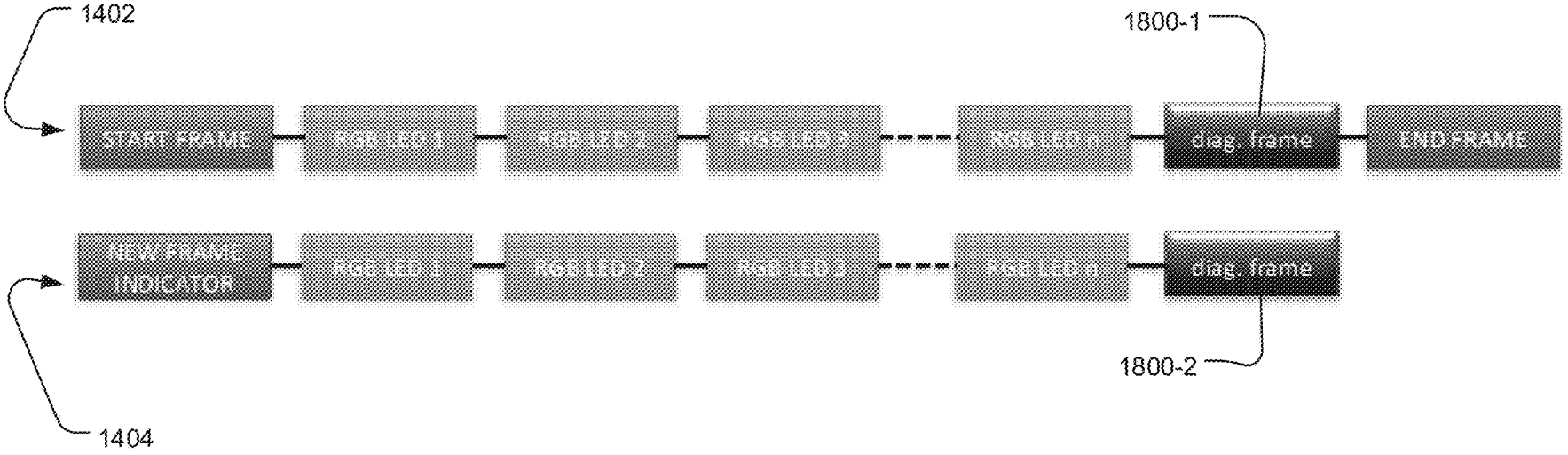
FIG. 18 is a diagram of exemplary display frames indicating the display instructions, which include diagnostic data.

FIG. 18 is a diagram of exemplary display frames 1402, 1404 indicating the display instructions including the pixel data used by the pixels 118 and the diagnostic data used by the lamp string monitor 232-1. These display frames 1402, 1404 are generated by the controller 226 and transmitted through each of the LED strings 116-L, for example, in steps 1708, 1710 and 1712 of the process that was previously described with respect to FIG. 17.

The display frames 1402, 1404 are similar to the ones described with respect to FIG. 14.

Now, however, the display frames 1402, 1404 each include a trailing diagnostic sequence 1800. The trailing diagnostic sequence 1800 is included after the pixel data associated with the final pixel 118 of the terminal LED string 116-L.

FIG. 19 is a sequence diagram illustrating in more detail the process by which the controller 226 determines the diagnostic status of the sound indicator 116-S, input modules 222, and the LED strings 116-L. This process corresponds, for example, with step 1706 of the process that was previously described with respect to FIG. 17.

First, in step 1900, the controller 226 periodically sends test signals to the sound indicator 116-S. In one example, the test signals are distinct pulse patterns with a value representing an ultra-sonic (e.g. inaudible) frequency.

In step 1902, the sound indicator 116-S emits ultra-sonic chirps based on the test signals (e.g. at the ultra-sonic frequency, pulsed according to the same pulse pattern as the test signals). The sound indicator 116-S, via the embedded diagnostic monitor 232-4 elements, detects the chirps and generates response signals (e.g. a digital logic representing the pulse sequence of the detected chirps). In step 1904, the sound indicator 116-S returns the response signals to the controller 226.

In step 1906, the controller 226 determines the diagnostic status of the sound indicator 116-S based on the response signals. For example, if the same testing signal input by the controller 226 to the sound indicator 116-S is replicated in the response signals, the controller 226 determines that the siren circuitry is electrically and mechanically functional.

In step 1908, the controller 226 receives digital/analog signals from the monitored system 208 via the input modules 222. In step 1910, the controller 226 determines the diagnostic status of the input modules 222 based on the digital/analog control signals 244. In one example, the controller 226 determines that there is an input fault condition in response to receiving analog control signals 244 that are outside a predetermined range. In another example, the controller 226 determines that there is an input fault condition in response to receiving a fault signal from any of the input modules 222.

In step 1911, the controller 226 generates and sends display instructions to the LED strings 116-L. In one example, the display instructions reflect the normal operation of the signaling device 102. In another example, the display instructions are part of a diagnostic animation sequence, for example, instructing each individual pixel 118 or LED of a pixel 118, for each LED string 116-L, to turn on and then off.

In step 1912, the LED strings 116-L present the status information 246-L during normal operation of the signaling device 102 and/or as part of the LED diagnostic animation.

In step 1914, the current monitor 232-2 evaluates the electrical load for the circuit providing power to the light indicators 116-L (e.g. by measuring the current consumed by the LED strings 116-L) and, in step 1916, sends the evaluated electrical load or measured current to the controller 226.

Finally, in step 1918, the controller 226 determines the diagnostic status of the light indicators 116-L, including each of the LED strings 116-L or the individual pixels 118 of each string, based on the evaluated electrical load.

While this invention has been particularly shown and described with references to preferred embodiments thereof, it will be understood by those skilled in the art that various changes in form and details may be made therein without departing from the scope of the invention encompassed by the appended claims.

What is claimed is:

1. A signaling device for presenting status information for a monitored system, the signaling device comprising:

an assembly including a plurality of indicating surfaces arranged at different viewing directions around the assembly;

light indicators arranged across the indicating surfaces, the light indicators presenting the status information;

input circuits for receiving control signals from the monitored system and signaling instructions from a configuration device, wherein the signaling instructions include animation scripts indicating animations to be presented via the light indicators based on the control signals; and a controller for driving the light indicators based on the control signals and the signaling instructions; and a current monitor for evaluating an electrical load of a circuit providing power to the light indicators by monitoring a current consumed by the light indicators and outputting a signal indicating the measured current to the controller, which determines a diagnostic status of the light indicators based on the measured current; and wherein during periods of presenting the animations via the light indicators, the controller determines the diagnostic status of the light indicators based on correlation between the measured current and expected current consumption for each frame of the animations.

2. The signaling device as claimed in claim 1, wherein the assembly has a cylindrical or prism shape and is divided into functional segments along an axis of the assembly, the functional segments including a light segment, which comprises the indicating surfaces and the light indicators, wherein an axial length of the light segment is customizable.

3. The signaling device as claimed in claim 1, wherein the arrangement of indicating surfaces and light indicators provides a range of potential viewing directions of 360 degrees.

4. The signaling device as claimed in claim 1, wherein the light indicators include addressable pixels.

5. The signaling device as claimed in claim 4, wherein the signaling instructions include maps representing the addressable pixels with pixel data for each of the addressable pixels indicating illumination and/or color status for the pixels.

6. The signaling device as claimed in claim 5, wherein the signaling instructions include animation scripts indicating different sequences of maps, the sequences representing animations to be presented via the light indicators.

7. The signaling device as claimed in claim 6, wherein the maps include roll maps, which include columns of pixels associated with each of the indicating surfaces and create a looping effect for animations across all of the indicating surfaces by designating a rightmost column as a next column to the left of a leftmost column and designating the leftmost column as a next column to the right of the rightmost column.

8. The signaling device as claimed in claim 1, wherein the animation scripts simulate continuous looping movement of illuminated regions across all of the indicating surfaces.

9. The signaling device as claimed in claim 8, wherein a currently running animation script is executed repeatedly as long as decoded input from the input circuits matches an index associated with the currently running animation script.

10. The signaling device as claimed in claim 1, wherein the assembly has a cylindrical or prism shape and is divided into functional segments along an axis of the assembly, each of the functional segments housing different components of the signaling device based on types of functions performed by the components, the electrical components of each of the segments having electrical connections to electrical components of one or more other segments.

11. The signaling device as claimed in claim 10, wherein the functional components include a driver segment housing the controller and the input circuits and one or more light segments housing the light indicators.

12. The signaling device as claimed in claim 11, wherein the driver segment is configured to be used with a customizable quantity of light segments or a light segment with a customizable length.

13. The signaling device as claimed in claim 11, wherein the one or more light segments are hollow shells allowing airflow cooling of the light indicators and other electrical components of the signaling device or providing a resonant cavity for sound indicators of the signaling device to emit sound.

14. The signaling device as claimed in claim 1, wherein the controller determines the diagnostic status of the light indicators by detecting and/or determining positions of damaged light-emitting diodes (LEDs) of the light indicators by processing a number of impulses of the measured current against a known number of LEDs.

15. The signaling device as claimed in claim 1, further comprising a diagnostic indicator, wherein the controller presents the diagnostic status of the light indicators via the diagnostic indicator.

16. A signaling device for presenting status information for a monitored system, the signaling device comprising:

indicators for presenting the status information based on control signals; and input circuits for receiving the control signals from the monitored system, wherein the input circuits process the control signals as analog or digital control signals based on polarities of the received control signals by receiving control signals having one of a first polarity and a second polarity and processing the received control signals with the first polarity as analog control signals and processing the received control signals having the second polarity as digital control signals.

17. The signaling device as claimed in claim 16, wherein each of the input circuits comprises a first input and a second input, control signals having the first polarity include a current directed into the input circuit via the second input and returned to a source of the current via the first input, and control signals having the second polarity include a current directed into the input circuit via the first input and returned to a source of the current via the second input.

18. The signaling device as claimed in claim 17, wherein the input circuit receives a control signal having the first polarity as an analog current, and the input circuit receives a control signal having the second polarity as a voltage digital input.

19. The signaling device as claimed in claim 18, wherein the input circuit receives the control signal having the first polarity as an analog current by directing a current of the control signal to a first branch of circuitry of the input circuit and transmitting the control signal as an output voltage to a controller via an analog output of the input circuit, and the input circuit receives the control signal having the second polarity as a voltage digital input by directing a current of the control signal to a second branch of circuitry of the input circuit and transmitting the control signal as a digital signal via a digital output of the input circuit.

20. The signaling device as claimed in claim 19, wherein the first branch of circuitry comprises a shunt for evaluating the control signal and an isolation amplifier for transmitting the control signal as the output voltage via the analog output to an analog-to-digital converter input of a controller of the signaling device.

21. The signaling device as claimed in claim 19, wherein the second branch of circuitry comprises a digital optical isolation amplifier, which the current is fed to the digital optical isolation amplifier when the input is in a high state, which turns output of the digital optical isolation amplifier to a low state representing a digital signal, which is output via the digital output to a controller of the signaling device.

22. The signaling device as claimed in claim 21, further comprising a fault optical isolation amplifier, wherein failure of an internal light-emitting diode (LED) of the digital optical isolation amplifier causes the fault optical isolation amplifier to output a fault signal to the controller.

23. The signaling device as claimed in claim 22, further comprising a Zener diode in series with the fault optical isolation amplifier, wherein the Zener diode and the internal LED of the digital optical isolation amplifier dropping voltage of the optical isolation amplifier cause the fault optical isolation amplifier to be not biased, and the failure of the internal LED causes the fault optical isolation amplifier to be biased, resulting in the output of the fault signal.

24. The signaling device as claimed in claim 22, wherein each of the input circuits output fault signals to the controller via a common fault output such that failure of any one of the input circuits generates the fault signal.

25. The signaling device as claimed in claim 22, further comprising a diagnostic indicator, wherein the controller presents the diagnostic status of the input circuits via the diagnostic indicator.

* * * * *